US009483903B2

(12) United States Patent
Wotton et al.

(10) Patent No.: US 9,483,903 B2
(45) Date of Patent: Nov. 1, 2016

(54) GAMING DEVICE AND METHOD FOR PROVIDING WAGERING FOR ADDITIONAL SYMBOL FUNCTIONALITY AND PACKAGE BETTING

(75) Inventors: Adrian Wotton, Marrickville (AU); Karen M Cregan, Kirrawee (AU); Peter Gerrard, Manchester (GB); Erick T Ching, Reno, NV (US); Dov L Randall, Reno, NV (US); Anthony J Baerlocher, Reno, NV (US)

(73) Assignee: IGT, Las Vegas, NV (US)

( * ) Notice: Subject to any disclaimer, the term of this patent is extended or adjusted under 35 U.S.C. 154(b) by 1953 days.

(21) Appl. No.: 11/928,837

(22) Filed: Oct. 30, 2007

(65) Prior Publication Data

US 2008/0182650 A1 Jul. 31, 2008

Related U.S. Application Data

(60) Provisional application No. 60/864,676, filed on Nov. 7, 2006.

(51) Int. Cl.
*G07F 17/32* (2006.01)
*G07F 17/34* (2006.01)

(52) U.S. Cl.
CPC ..... *G07F 17/3213* (2013.01); *G07F 17/32* (2013.01); *G07F 17/3239* (2013.01); *G07F 17/3244* (2013.01); *G07F 17/34* (2013.01)

(58) Field of Classification Search
CPC ..... G07F 17/3213; G07F 17/32; G07F 17/3244; G07F 17/34; G07F 17/3239
USPC ..... 463/16, 20, 25, 30, 31, 40–42, 43, 463/11–13, 17–19
See application file for complete search history.

(56) References Cited

U.S. PATENT DOCUMENTS 4,669,731 A 6/1987 Clarke
4,695,053 A 9/1987 Vazquez, Jr. et al.
4,991,848 A 2/1991 Greenwood et al.
(Continued)

FOREIGN PATENT DOCUMENTS

WO WO 01/15055 3/2001
WO WO 01/15055 A1 * 3/2001 ..... G06F 19/00
(Continued)

OTHER PUBLICATIONS

Documents related to the Best-and-Fairest game, available prior to Aug. 2005 and submitted in Information Disclosure Statements dated Apr. 16, 2007 for U.S. Appl. No. 11/365,007, 11/365,177, and 11/445,969.
(Continued)

*Primary Examiner* — Omkar Deodhar
*Assistant Examiner* — Matthew D. Hoel
(74) *Attorney, Agent, or Firm* — Neal, Gerber & Eisenberg LLP

(57) ABSTRACT

A gaming device which includes a plurality of different predefined wager packages. Each predefined wager package is associated with a wager amount or value and includes one or more of a plurality of different game play features. In operation, the gaming device enables players to wager an amount equal to one of the plurality of predefined wager packages available to the player. The game play features associated with the wagered on predefined wager package are activated for one or more plays of a game.

20 Claims, 10 Drawing Sheets

(56) References Cited

U.S. PATENT DOCUMENTS

| | | | | |
|---|---|---|---|---|
| 5,116,055 | A | 5/1992 | Tracy | |
| 5,123,649 | A | 6/1992 | Tiberio | |
| 5,397,125 | A | 3/1995 | Adams | |
| 5,511,781 | A | 4/1996 | Wood et al. | |
| 5,823,874 | A | 10/1998 | Adams | |
| 5,993,316 | A | 11/1999 | Coyle et al. | |
| 6,001,016 | A * | 12/1999 | Walker et al. | 463/42 |
| 6,062,980 | A | 5/2000 | Luciano | |
| 6,068,552 | A | 5/2000 | Walker et al. | |
| 6,102,394 | A | 8/2000 | Wurz | |
| 6,102,400 | A | 8/2000 | Scott et al. | |
| 6,110,041 | A | 8/2000 | Walker et al. | |
| 6,117,010 | A | 9/2000 | Canterbury et al. | |
| 6,126,542 | A | 10/2000 | Fier | |
| 6,155,925 | A | 12/2000 | Giobbi et al. | |
| 6,158,741 | A | 12/2000 | Koelling | |
| 6,159,097 | A | 12/2000 | Gura | |
| 6,174,233 | B1 | 1/2001 | Sunaga et al. | |
| 6,174,235 | B1 | 1/2001 | Walker et al. | |
| 6,203,429 | B1 | 3/2001 | Demar et al. | |
| 6,224,482 | B1 | 5/2001 | Bennett | |
| 6,224,483 | B1 | 5/2001 | Mayeroff | |
| 6,227,969 | B1 | 5/2001 | Yoseloff | |
| 6,231,442 | B1 | 5/2001 | Mayeroff | |
| 6,231,445 | B1 | 5/2001 | Acres | |
| 6,234,897 | B1 | 5/2001 | Frohm et al. | |
| 6,244,957 | B1 | 6/2001 | Walker et al. | |
| 6,254,482 | B1 | 7/2001 | Walker et al. | |
| 6,270,409 | B1 | 8/2001 | Shuster | |
| 6,299,165 | B1 | 10/2001 | Nagano | |
| 6,309,299 | B1 | 10/2001 | Weiss | |
| 6,315,662 | B1 | 11/2001 | Jorasch et al. | |
| 6,467,770 | B1 | 10/2002 | Matosevic | |
| 6,520,856 | B1 | 2/2003 | Walker et al. | |
| 6,612,927 | B1 * | 9/2003 | Slomiany et al. | 463/16 |
| 6,692,003 | B2 | 2/2004 | Potter et al. | |
| 6,726,565 | B2 | 4/2004 | Hughs-Baird | |
| 6,776,714 | B2 | 8/2004 | Ungaro et al. | |
| 6,991,544 | B2 | 1/2006 | Soltys et al. | |
| 7,029,395 | B1 | 4/2006 | Baerlocher | |
| 7,070,505 | B2 | 7/2006 | Vancura et al. | |
| 7,077,746 | B2 | 7/2006 | Torango | |
| 7,094,150 | B2 | 8/2006 | Ungaro et al. | |
| 7,156,741 | B2 | 1/2007 | Hornik et al. | |
| 7,229,354 | B2 | 6/2007 | McNutt et al. | |
| 7,241,221 | B1 | 7/2007 | Luciano, Jr. et al. | |
| 7,297,059 | B2 | 11/2007 | Vancura et al. | |
| 7,419,429 | B2 | 9/2008 | Taylor | |
| 2002/0065123 | A1 | 5/2002 | Packes, Jr. et al. | |
| 2003/0060266 | A1 | 3/2003 | Baerlocher | |
| 2003/0069068 | A1 | 4/2003 | Kaminkow | |
| 2003/0232640 | A1 | 12/2003 | Walker et al. | |
| 2004/0058727 | A1 | 3/2004 | Marks et al. | |
| 2004/0063492 | A1 | 4/2004 | Baerlocher et al. | |
| 2004/0111358 | A1 | 6/2004 | Lange et al. | |
| 2004/0192432 | A1 | 9/2004 | Walker et al. | |
| 2005/0026676 | A1 | 2/2005 | Olive | |
| 2005/0054429 | A1 | 3/2005 | Baerlocher et al. | |
| 2005/0060050 | A1 | 3/2005 | Baerlocher | |
| 2006/0040725 | A1 | 2/2006 | Walker et al. | |
| 2006/0040730 | A1 | 2/2006 | Walker et al. | |
| 2006/0046836 | A1 | 3/2006 | Walker et al. | |
| 2006/0068883 | A1 | 3/2006 | Randall et al. | |
| 2006/0068903 | A1 | 3/2006 | Walker et al. | |
| 2006/0079321 | A1 | 4/2006 | Walker et al. | |
| 2006/0084497 | A1 | 4/2006 | Marks et al. | |
| 2006/0089191 | A1 | 4/2006 | Singer et al. | |
| 2006/0111175 | A1 | 5/2006 | Walker et al. | |
| 2006/0121969 | A1 | 6/2006 | Marks et al. | |
| 2006/0128457 | A1 | 6/2006 | Cannon | |
| 2006/0154723 | A1 | 7/2006 | Saffari et al. | |
| 2006/0157928 | A1 | 7/2006 | O'Halloran | |
| 2006/0178205 | A1 | 8/2006 | Bleich et al. | |
| 2006/0183535 | A1 | 8/2006 | Marks et al. | |
| 2006/0189387 | A1 | 8/2006 | Rigsby et al. | |
| 2006/0211484 | A1 | 9/2006 | Hornik et al. | |
| 2006/0211489 | A1 | 9/2006 | Walker et al. | |
| 2006/0223615 | A1 | 10/2006 | Englman | |
| 2006/0252516 | A1 | 11/2006 | Walker et al. | |
| 2006/0279044 | A1 | 12/2006 | Pacey | |
| 2006/0287090 | A1 | 12/2006 | Ocampo | |
| 2007/0026923 | A1 | 2/2007 | Muir | |
| 2007/0054726 | A1 | 3/2007 | Muir et al. | |
| 2007/0060255 | A1 | 3/2007 | Baerlocher et al. | |
| 2007/0060321 | A1 | 3/2007 | Vasquez et al. | |
| 2007/0167201 | A1 | 7/2007 | Schultz | |
| 2007/0184891 | A1 | 8/2007 | Thomas | |
| 2007/0191087 | A1 | 8/2007 | Thomas et al. | |
| 2007/0265061 | A1 | 11/2007 | Marks et al. | |
| 2007/0270208 | A1 | 11/2007 | Caspers et al. | |

FOREIGN PATENT DOCUMENTS

| | | |
|---|---|---|
| WO | WO 2006/014657 | 2/2006 |
| WO | WO 2006/060436 | 6/2006 |
| WO | WO 2007/084766 | 7/2007 |
| WO | WO2008039174 | 4/2008 |

OTHER PUBLICATIONS

Description of Konami Gaming, Mystical Temple Gaming Device in Slots: Best of the Show article, written by Frank Legato, published by Casino Player Publishing in 2007.

Button Panel Configuration, available on publically sold gaming machines prior to Nov. 2006.

* cited by examiner

GAMING DEVICE AND METHOD FOR PROVIDING WAGERING FOR ADDITIONAL SYMBOL FUNCTIONALITY AND PACKAGE BETTING

PRIORITY CLAIM

This application is a non-provisional application of, claims priority to and the benefit of U.S. Provisional Patent Application Ser. No. 60/864,676, filed on Nov. 7, 2006, the entire contents of which are incorporated herein.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Symbols or symbol combinations which are less likely to occur usually provide higher awards.

In one known slot gaming device, the gaming device includes a plurality of reels and one or more paylines. Such gaming devices include any suitable number of reels, such as three to five reels, which each display any suitable number of symbols per reel, such as three symbols per reel, wherein each reel includes one symbol displayed in each of a plurality of symbol positions on that reel. Such gaming devices may have one, three, five, nine, fifteen, twenty-five or any other suitable number of paylines which are horizontal, vertical, diagonal or any combination thereof.

In certain known slot gaming machines, upon placing one or more wagers, the reels spin to generate a plurality of symbols and the gaming device analyzes the generated symbols to determine if the gaming device has randomly generated a winning symbol or winning symbol combination on or along one or more of the wagered on paylines. Any awards associated with any generated winning symbols or winning symbol combinations generated along any wagered on paylines are provided to the player. Alternatively, any awards associated with any winning symbols or winning symbol combinations that are generated anywhere on a wagered on payline (i.e., a line scatter pay) or anywhere on the reels (i.e., a reel scatter pay) are provided to the player.

In these gaming machines, the awards provided to the player are generally based on the number of paylines that pass through each of the winning symbol combinations. That is, the gaming device separately analyzes each wagered on payline to determine if a winning symbol combination is generated on that payline. For each occurrence of each payline passing through a winning symbol combination, the gaming device provides the player the award associated with that winning symbol combination. For example, in a five reel gaming device, if four related symbols (which form a winning symbol combination) are generated by the first four reels and twelve paylines pass through the first three of those related symbols (i.e., three paylines running left to right pass through all four related symbols and nine paylines running left to right pass through the first three related symbols), the gaming device provides the player twelve awards (i.e., one award for each payline that passes through the winning symbol combination). These twelve separate awards are each for the single occurrence of the winning symbol combination including the four related symbols. Accordingly, in a gaming device with wagering on paylines, the greater the number of wagered on paylines that pass through a winning symbol combination, the greater the award as compared to an identical winning symbol combination in which fewer wagered on paylines pass through the same winning symbol combination.

In these known gaming machines, the amount of the wager made on the base game by the player may vary. For instance, the gaming machine may enable the player to wager a minimum number of credits, such as one credit (e.g., one penny, nickel, dime, quarter or dollar) up to a maximum number of credits, such as five credits. In one known slot gaming device, the player wagers on a number or combination of paylines, such as one, two, three, five, ten or fifteen paylines. Thus, it is known that a gaming machine, such as a slot game, may enable players to make wagers of substantially different amounts on each play of the primary or base game ranging, for example, from 1 credit up to 125 credits (e.g., 5 credits on each of 25 separate paylines). This is also true for other wagering games, such as video draw poker, where players can wager one or more credits on each hand and where multiple hands can be played simultaneously. Accordingly, it should be appreciated that different players play at substantially different wagering amounts or levels and at substantially different rates of play.

In these gaming devices, a player is only enabled to control the number of paylines associated their game and what bet is applied per payline played. For certain players, such a configuration is discouraging because they feel limited in how they can apply their wager. That is, increasing their wager does not necessarily increase their chance of winning an award. Unless a winning outcome is generated on each spin, these players do not feel that their additional wager provides them with any benefit or advantage. Moreover, with the different inputs a player must engage to select which paylines to wager on and the amount to wager on each payline, certain players experience at least some level of confusion regarding how to place a wager on these existing gaming devices.

In another type of gaming device with reels, the player wagers on a number of ways to win, wherein any award provided to the player is based on the number of associated symbols which are generated in active symbol positions on a requisite number of adjacent reels (i.e., not on paylines passing through any displayed winning symbol combinations). In such known ways to win gaming devices, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). Modifying the number of generated symbols by either modifying the number of reels or modifying the number of symbols generated in active symbol positions by one or more of the reels, modifies the number of ways to win.

Secondary or bonus games are also known in gaming machines. The secondary or bonus games usually provide an additional award to the player. Secondary or bonus games usually do not require an additional wager by the player to be activated. Secondary or bonus games are generally activated or triggered upon an occurrence of a designated triggering symbol or triggering symbol combination in the primary or base game. For instance, a bonus symbol occurring on the payline on the third reel of a three reel slot machine may trigger the secondary bonus game. Part of the enjoyment and excitement of playing certain gaming machines is the occurrence or triggering of the secondary or bonus game (even before the player knows how much the bonus award will be). In other words, obtaining a bonus event and a bonus award in the bonus event is part of the enjoyment and excitement for players.

There is a continuing need to provide new and different gaming machines and gaming systems as well as new and different ways to provide awards to players including bonus awards.

SUMMARY

In one embodiment, the gaming device disclosed herein includes a plurality of different predefined wager packages. Each predefined wager package is associated with a wager amount or wager value and includes one or more of a plurality of different game play features or characteristics as disclosed herein. In this embodiment, different predefined wager package are associated with different types of game play features or characteristics and different quantities of game play features or characteristics. It should be appreciated that certain game play features are related to one or more events which occur during a play of a primary game, certain game play features are related to one or more events which occur during any play of a secondary game and certain game play features are related to one or more aspects of which award, if any, is determined and provided to the player.

In one such embodiment, different predefined wager packages are associated with different average expected payouts (relative to the amount wagered) for the player. In another such embodiment, at least two different predefined wager packages are associated with the same wager amount or value and the same average expected payout but different volatilities of awards available. In another such embodiment, the greater the wager amount associated with a predefined wager package, the greater the number of game play features included in that predefined wager package.

In another embodiment, the gaming device utilizes predefined wager packages to provide one or more cost benefits to the player. For example, a first predefined wager package associated with a first wager amount includes, amongst other features, a first number of paylines, and a second predefined wager package associated with a second wager amount (which is linearly related to the first wager amount) includes, amongst other features, a second number of paylines, wherein the second number of paylines is higher than and non-linearly related to the first number of paylines. For example, a first predefined wager package associated with a wager amount of two credits includes activating four paylines, while a second predefined wager package associated with a wager amount of four credits includes activating five paylines. Accordingly, by enabling the player to wager on a plurality of different game play features as a package (rather than individually), the gaming device disclosed herein enables the player to wager on such different game play features at a discount to when these game play features are wagered on individually.

In operation of one such embodiment, the gaming device enables players to wager an amount equal to one of the plurality of predefined wager packages available to the player. The gaming device enables the player to select and wager on one of the predefined wager packages (in one embodiment using a single input device associated with that wager package) to activate the plurality of game play features associated with the selected wager package. In this embodiment, the game play features associated with the wagered on predefined wager package are activated for one or more plays of a game. Such a configuration enables players a greater level of control in how their wager is applied to the game and the different game features their wager contributes to.

In one embodiment, one of the game play features of one of the predefined wager packages includes the gaming device providing additional symbol functionality to one or more of the symbols. In one such embodiment, one of the game play features of one of the predefined wager packages includes the gaming device activating one or more secondary symbols, such as sub-symbols, for one or more plays of a game. In another such embodiment, one of the game play features of one of the predefined wager packages includes the gaming device causing one or more symbols to change to (or otherwise function as) wild symbols for one or more plays of a game. In another such embodiment, one of the game play features of one of the predefined wager packages includes the gaming device increasing the number of one or more designated symbols in a symbol set (and thus increases the probability that such designated symbols will be generated) for one or more plays of a game.

In one embodiment, one of the game play features of one of the predefined wager packages includes the gaming device activating one or more secondary symbol features. In this embodiment, a plurality of primary symbols on the reels are each associated with a secondary symbol, such as a sub-symbol, that is activated if a wager is placed on an appropriate predefined wager package. If such secondary symbols are generated during one or more plays of a game, one or more awards may be provided to the player (which would otherwise not have been provided if a wager was not placed on the appropriate predefined wager package to activate the secondary symbols). In one example embodiment, one of the game play features of one of the predefined wager packages includes the gaming device activating one or more secondary symbols for one or more plays of a game. In this example embodiment, if one or more of such activated secondary symbols (or one or more of the primary symbols associated with such activated secondary symbols) are generated in any symbol positions on the reels (i.e., in a scatter configuration), the gaming device provides an award to the player. Such a configuration provides the player with a greater chance of winning awards than if the gaming device did not provide any awards for any winning scattered symbols or scatter symbol combinations. In another example embodiment, one of the game play features of one of the predefined wager packages includes the gaming device activating one or more wild secondary symbols for one or more plays of a game. In this example embodiment, any generated wild secondary symbols cause the gaming device to evaluate the generated primary symbol associated with the activated wild secondary symbol as if it was a wild symbol. This example embodiment provides the player with a greater chance of winning awards than if no wilds are available.

In another example embodiment, one of the game play features of one of the predefined wager packages includes the gaming device activating one or more progressive award secondary symbols for one or more plays of a game. In this example embodiment, if one or more of such activated progressive award secondary symbols are generated during a play of the game (either along a wagered on payline or in a scatter configuration), the gaming device provides the player a progressive award or a bonus sequence for a chance to win a progressive award. This example embodiment provides the player with a chance at winning a progressive award for selecting to wager on a certain predefined wager package by using secondary symbols that are not otherwise available to be generated. In another example embodiment, one of the game play features of one of the predefined wager packages includes the gaming device activating one or more bonus game secondary symbols for one or more plays of a game. In this example embodiment, if one or more of such activated bonus game secondary symbols are generated during a play of the game (either along a wagered on payline or in a scatter configuration), the gaming device enables the player to participate in a suitable bonus game to win or more bonus awards.

In another embodiment, one of the game play features of one of the predefined wager packages includes the gaming device providing that one or more designated symbols will function as wild symbols if such symbols are generated on the reels. In one such embodiment, the greater the wager amount associated with the player's selected predefined wager package, a greater number of designated symbols will function as wild symbols if such symbols are generated on the reels. This configuration provides that by selecting to wager on a certain predefined wager package to increase their odds of generating one or more wild symbols, the player is increasing their odds that one or more winning symbol combinations will be generated and one or more awards will be provided to the player.

In another embodiment, one of the game play features of one of the predefined wager packages includes modifying the number of one or more designated symbols in the symbol set for one or more plays of a game. In one such embodiment, if the player is playing a collection game wherein the gaming device provides awards for collecting a number of designated symbols, one of the game play features of one of the predefined wager packages includes causing the gaming device to increase the number of designated symbols available to the player, thus increasing the player's odds of collecting the amount required to win an award. In one such embodiment, one of the game play features of one of the predefined wager packages includes increasing the number of a designated symbol in a symbol set to increase the probability that such designated symbol is generated (which increases the player's probability of winning an award if the designated symbol is included in one or more winning symbol combinations).

In another embodiment, one of the game play features of one of the predefined wager packages includes the gaming device causing one or more symbols to function as split symbols or N count symbols for one or more plays of a game. A split or N count symbol is a symbol that includes a plurality of individual symbols in a single symbol position. Such split symbols enable the gaming device to generate more symbols on the reels and thus increase the probability that a winning symbol combination will occur. In this embodiment, when evaluating the generated symbols to determine if a winning symbol or combination of symbols is generated, the gaming device accounts for each symbol generated in a single symbol position. In one such embodiment, the greater the wager amount associated with a predefined wager package, the greater the number of symbols generated in a single symbol position. In one example, if a winning symbol combination includes three symbols, by selecting to wager on a designated wager package, the gaming device must only generate a 2 count symbol (i.e., a split symbol with two symbols in a single symbol position) in one symbol position and a normal or 1 count symbol in another symbol position to provide the player the award associated with the winning symbol combination. In this example, by selecting to wager on the designated wager package, the player is provided additional winning opportunities that are not otherwise available. That is, had the player not placed the wager associated with the designated wager package, this example would not have resulted in the player winning an award because two symbols in two symbol positions is not a winning symbol combination associated with an award. Therefore, by selecting to wager on a designated predefined wager package to activate one or more split symbols, the gaming device increases the player's excitement and enjoyment by enabling the player to have more symbols displayed on the reels which increases the probability that a winning combination of symbols will occur on the reels.

In one such embodiment, if the player selects to wager on one of the predefined wager packages, the split symbols are utilized to create additional winning symbol combinations on supplemental paylines which all derive from the same wagered on payline. For example, as mentioned above, in known gaming devices, three normal or 1 count symbols (which form a winning symbol combination) generated on one payline provide one award to the player. However, in the embodiment disclosed herein wherein selecting and wagering on one of the predefined wager packages causes one or more split symbols to be generated, three 2 count symbols (which form a winning symbol combination) generated on one payline results in eight winning symbol combinations (i.e., 2×2×2) on eight supplemental paylines and thus provides eight awards to the player. This embodiment provides the player with a greater number of winning opportunities through these additionally derived supplemental paylines.

In another embodiment, if the player selects to wager on one of the predefined wager packages, the split symbols are utilized to create additional winning symbol combinations in a ways to win game. As discussed in more detail below, in this ways to win game, the gaming device determines any award to provide to the player based on the number of related symbols which are generated in wagered on or otherwise active symbol positions. In this embodiment, the gaming device analyzes the symbols generated and displayed in the active symbol positions to determine whether the symbols form a string of related symbols. If one or more strings of related symbols are formed in the game, the gaming device evaluates the symbols of each string of related symbols to determine whether those symbols correspond to any winning combinations of symbols. If so, the gaming device provides any outcomes, such as awards, associated with such winning combinations of symbols to the player. In this embodiment, if a wager is placed on one of the predefined wager packages, the split symbols are utilized to create additional winning ways to win by generating one or more additional symbols at one or more active symbol positions. That is, if a split symbol is generated in an active symbol position, each of the individual symbols which form the split symbol are analyzed separately in determining whether the symbols form a string of related symbols.

Accordingly, an advantage of the gaming device disclosed herein is to utilize predefined wager packages to enable a player with a greater level of control in how their wager is applied to the game and the different game features their wager contributes to.

Another advantage of the gaming device disclosed herein is to utilize predefined wager packages to enable the player to wager on a plurality of different game play features at a discount to when these game play features are wagered on individually.

Another advantage of the gaming device disclosed herein is to enable a player to select to wager on a predefined wager package to activate one or more additional symbol functions which provide one or more additional winning opportunities that would otherwise not be available to the player.

Another advantage of the gaming device disclosed herein is to increase the player's excitement and enjoyment by enabling the player to select to wager on a predefined wager package to activate one or more split symbols which increase the probability that a winning combination of symbols will occur on the reels.

Additional features and advantages are described in, and will be apparent from, the following Detailed Description and the figures.

DETAILED DESCRIPTION

The present disclosure may be implemented in various configurations for gaming machines, gaming devices or gaming systems, including but not limited to: (1) a dedicated gaming machine, gaming device or gaming system, wherein the computerized instructions for controlling any games (which are provided by the gaming machine or gaming device) are provided with the gaming machine or gaming device prior to delivery to a gaming establishment; and (2) a changeable gaming machine, gaming device or gaming system, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by at least one central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
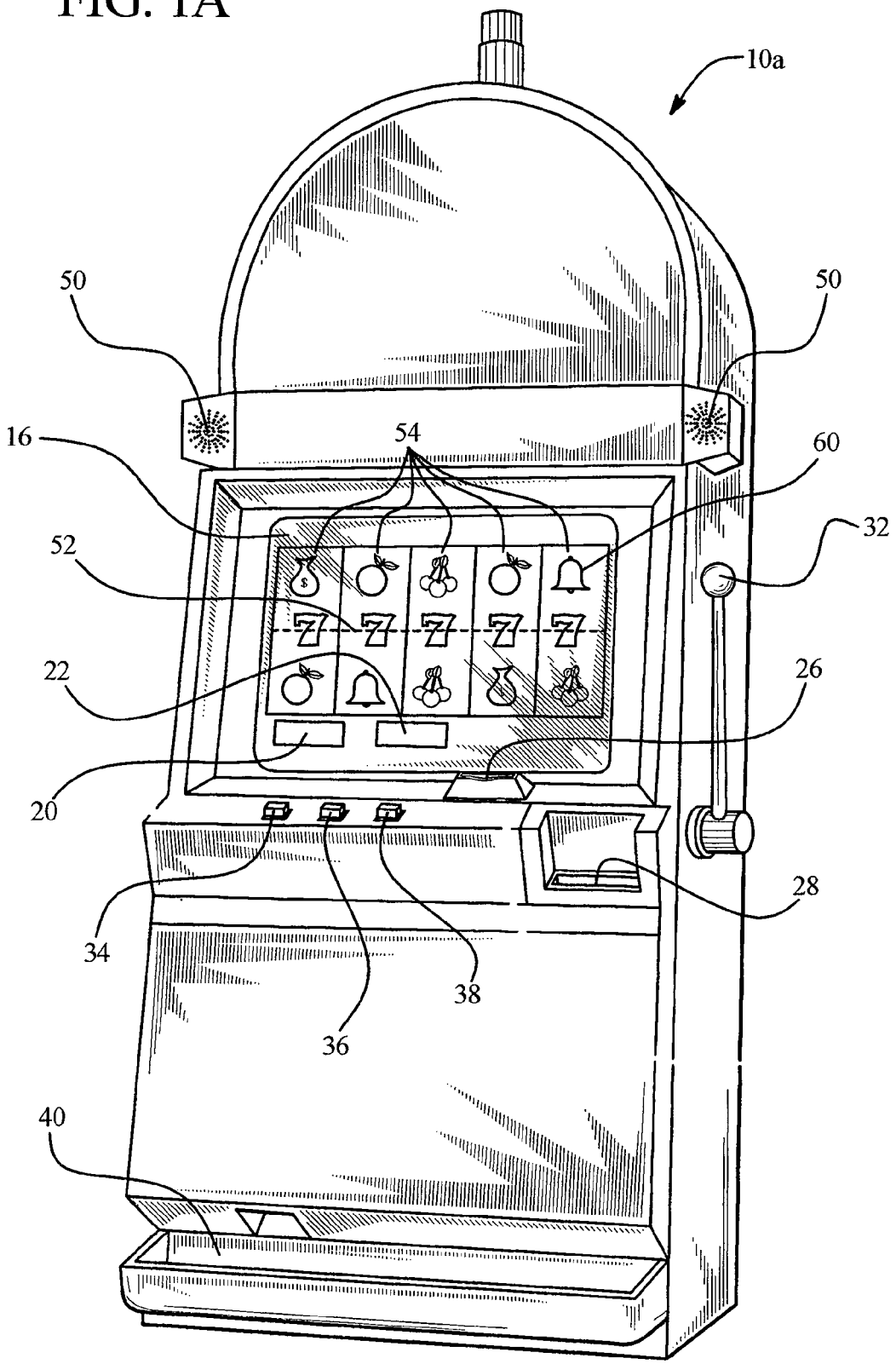
FIG. 1A is a front-side perspective view of one embodiment of the gaming device disclosed herein.
Figure 1B:
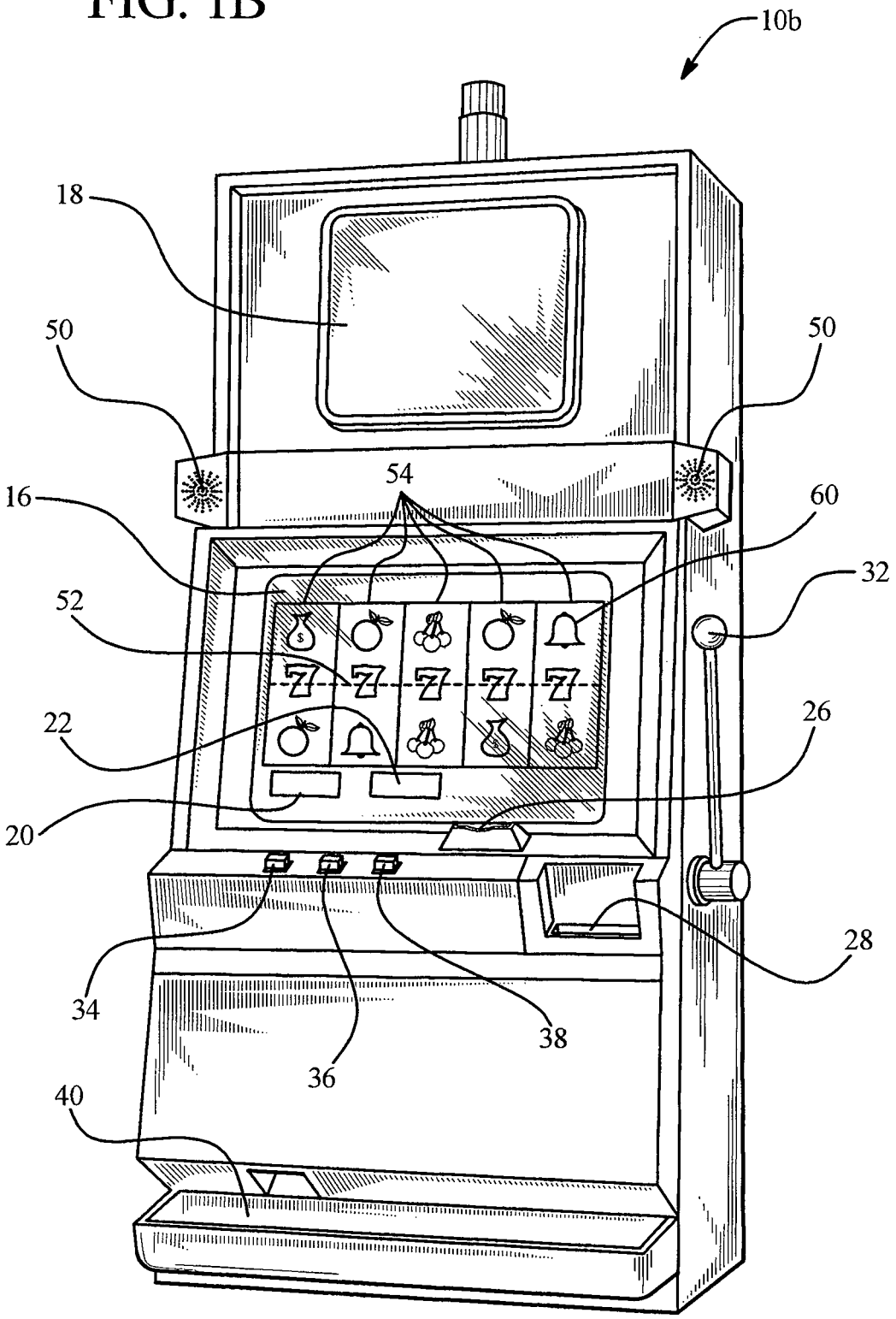
FIG. 1B is a front-side perspective view of another embodiment of the gaming device disclosed herein.

Referring now to the drawings, two example alternative embodiments of the gaming device of the disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
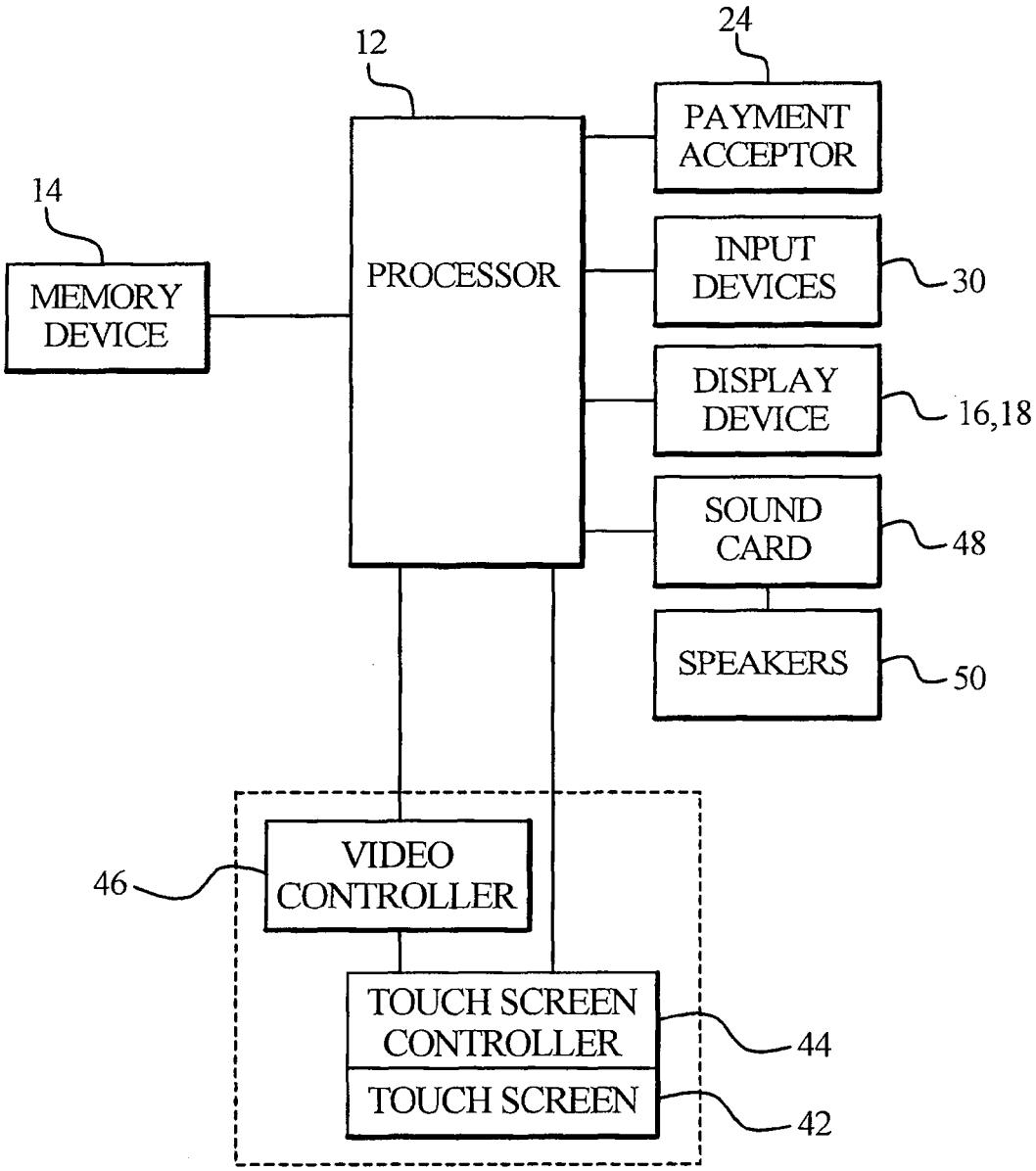
FIG. 2A is a schematic block diagram of the electronic configuration of one embodiment of the gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, the gaming device includes a bet display 22 which displays a player's amount wagered. In one embodiment, as described in more detail below, the gaming device includes a player tracking display (not shown) which displays information regarding a player's playing tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

As illustrated in FIG. 2A, in one embodiment, the gaming device includes at least one payment acceptor 24 in communication with the processor. As seen in FIGS. 1A and 1B, the payment acceptor may include a coin slot 26 and a payment, note or bill acceptor 28, where the player inserts money, coins or tokens. The player can place coins in the coin slot or paper money, a ticket or voucher into the payment, note or bill acceptor. In other embodiments, devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In another embodiment, when the player cashes out, a payment device, such as a ticket, payment or note generator prints or otherwise generates a ticket or credit slip to provide to the player. The player receives the ticket or credit slip and may redeem the value associated with the ticket or credit slip via a cashier (or other suitable redemption system). It should be appreciated that any suitable payout mechanisms, such as funding to the player's electronically recordable identification card, may be implemented in accordance with the gaming device disclosed herein.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device may include some or all of the features of conventional gaming machines or devices. The primary or base game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols 60, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement. For example, as seen in FIGS. 1A and 1B, when five normal or 1 count seven symbols (as described in more detail below) are generated along payline 52 to form a winning symbol combination, the gaming device provides one award to the player for the one winning symbol combination.

In an alternative embodiment, as mentioned above, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on at least three adjacent reels along a payline in the primary slot game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
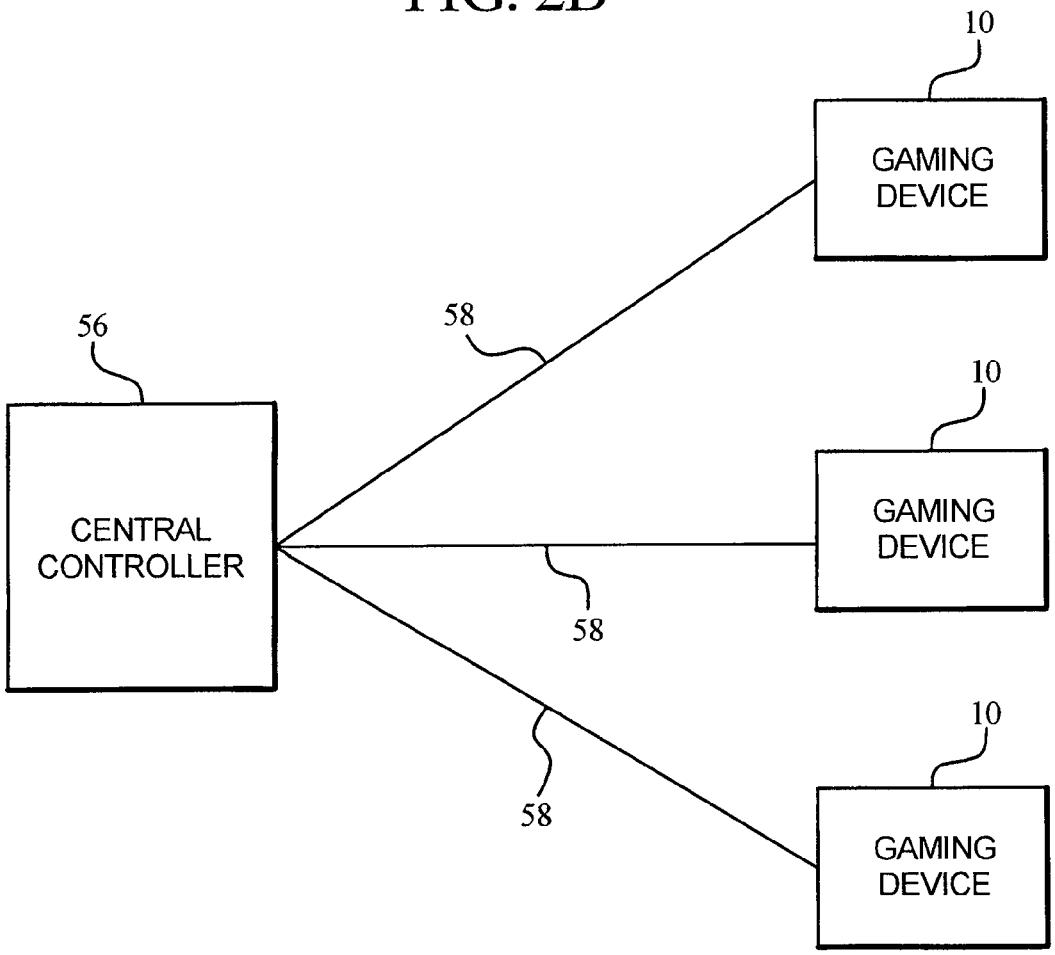
FIG. 2B is a schematic block diagram illustrating a plurality of gaming terminals in communication with a central controller.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo, keno or lottery game. In this embodiment, each individual gaming device utilizes one or more bingo, keno or lottery games to determine the predetermined game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any players gaming activity at the gaming device. In one such embodiment, the gaming device includes at least one card reader in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Predefined Wager Packages

In one embodiment, one or more game play features are combined to form one or more wager packages. In this embodiment, the gaming device disclosed herein includes a plurality of different predefined wager packages. Each predefined wager package is associated with a wager amount or wager value and includes one or more of a plurality of different game play features or characteristics as disclosed herein. In this embodiment, different predefined wager package are associated with different types of game play features or characteristics and different quantities of game play features or characteristics. It should be appreciated that certain game play features are related to one or more events which occur during a play of a primary game, certain game play features are related to one or more events which occur during any play of a secondary game and certain game play features are related to one or more aspects of which award, if any, is determined and provided to the player.

In operation of one embodiment, the gaming device enables players to wager an amount equal to one of the plurality of predefined wager packages available to the player. In this embodiment, the game play features associated with the wagered on predefined wager package are activated for one or more plays of a game. Such a configuration enables players a greater level of control in how their wager is applied to the game and the different game features their wager contributes to. Moreover, such a configuration reduces certain player's level of confusion regarding which of a plurality of game play features are available and how to wager on these existing game play features.

In different embodiments, in addition to the game play features described in detail below, the game play features or characteristics which may be packaged into one or more predefined wager packages include, but are not limited to: the number of active paylines, the number of active symbol positions, the type of bonus game the player may be eligible to play, the type of bonus award the player may win, if the player may win a progressive award or not, which one of a plurality of progressive awards the player may win, the number of wild symbols, if any, in the game, any applicable multipliers for the game, any applicable nudges, the number of free spins, if any, the player may win, the type of symbols utilized, how one or more symbols are evaluated, the symbol set utilized, or any other suitable game play feature otherwise known.

Figure 3:
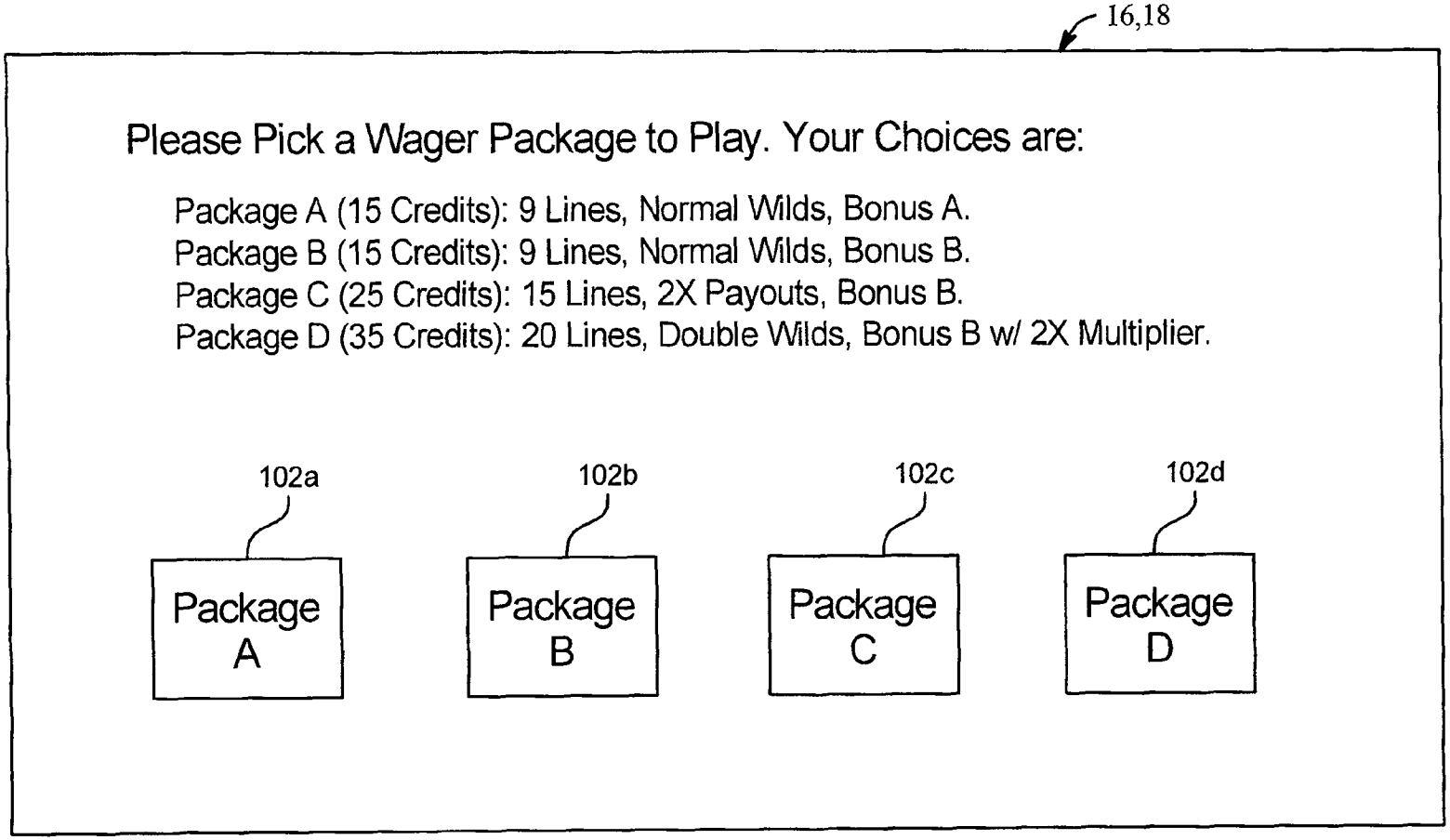
FIG. 3 is top plan view of one embodiment disclosed herein illustrating a plurality of different predefined wager packages available to the player.

As seen in FIG. 3, in one such example embodiment, the gaming device displays a plurality of different predefined wager packages to the player. In this example, each predefined wager package is associated with a separate input device, such as inputs 102*a* to 102*d*, which the player may engage to select one of the predefined wager packages. In this embodiment, the player selects one of the predefined wager packages (via the input device associated with that predefined wager package) and the wager amount or wager value associated with the selected predefined wager package is reduced from the player's credit meter. After selecting a predefined wager package, the gaming device enables the player to play one or more games wherein the game play features associated with the selected predefined wager package are applied. For example, if the player selected Package A by wagering fifteen credits, the gaming device would activate nine paylines, wherein wild symbols are active and upon a suitable triggering condition, the player participate in bonus game A. It should be appreciated that the gaming device disclosed herein enables a gaming device designer to incorporate any suitable game play features into any suitable predefined wager package.

In one embodiment, at least two different predefined wager packages are associated with the same wager amount or wager value but different applicable game play features. For example, as seen in FIG. 3, predefined wager package A associated with a wager amount of 15 credits provides a game which utilizes a first game play feature (i.e., the game is associated with bonus A), and predefined wager package B associated with the same wager amount of 15 credits provides a game which utilizes a different, second game play feature (i.e., the game is associated with bonus B). In another embodiment, as seen by comparing Package C to Package D in FIG. 3, at least two different predefined wager packages are associated with different wager amounts or values and different applicable game play features.

In another embodiment, the greater the wager amount associated with a predefined wager package, the greater the number of game play features included in that predefined wager package. For example, a first predefined wager package associated with a first wager amount includes three game play features (not otherwise available to the player) and is associated with a first average expected payout and a second predefined wager package associated with a second, greater wager amount includes four game play features (not otherwise available to the player) and is associated with a second, greater average expected payout. In another such embodiment, different predefined wager packages are associated with different average expected payouts (relative to the amount wagered) for the player, wherein the greater the number of game play features associated with a predefined wager package, the greater the average expected payout for that predefined wager package.

In another embodiment, at least two different predefined wager packages are associated with the same wager amount or value and the same average expected payout but different volatilities of awards available. For example, a first predefined wager package associated with a first wager amount provides a game with a first range of awards available to be provided to the player. In this example, a second predefined wager package associated with a second wager amount provides a game with a second range of awards available to the provided to the player, wherein the second range of awards is different than the first range of awards. In one embodiment, different predefined wager packages are associated with different paytables. In another embodiment, different predefined wager packages contribute different amounts to a bonus or secondary game. For example, one predefined wager package has a greater probability of triggering a bonus game and thus this predefined wager package contributes more to a bonus game paytable.

In another embodiment, the gaming device disclosed herein utilizes predefined wager packages to provide players a greater value for their existing wager. In one such embodiment, by packaging one or more game play features together for the player, the gaming device provides such game play features at a discount compared to when these game play features are wagered on individually. In one example embodiment, rather than requiring that a wager on one payline requires one credit wagered (as in existing gaming devices), the gaming device disclosed herein is operable to provide that a predefined package wager on a plurality of paylines requires less than one credit wagered per payline. It should be appreciated that such an example embodiment provides that linearly related wager amounts are associated with non-linearly related numbers of active paylines.

In another embodiment, the gaming device disclosed herein enables a gaming device designer to build or create any suitable predefined wager package. In one such embodiment, each game play feature is associated with an average expected payout if that game play feature is applicable for a primary game. In this embodiment, the gaming device enables the gaming device designer to select which game play features to include in a predefined wager package and the gaming device determines a wager amount to associate with the created predefined wager package (based on the average expected payouts associated with the selected game play features). In another embodiment, the gaming device enables a player to create one or more predefined wager packages. In this embodiment, the gaming device enables the player to select which game play features to include in a predefined wager package and the gaming device determines a wager amount to associate with the created predefined wager package (based on the average expected payouts associated with the selected game play features). In one embodiment, one or more of the player's determined predefined wager packages are stored for the player in association with a suitable player tracking system. In different embodiments, the player is enabled to set up one or more predefined wager packages via the gaming device, the internet, a player tracking device, a service window, a kiosk, or any other suitable manner.

In another embodiment, one or more predefined wager packages are associated with placing a plurality of wagers on a plurality of different games. In one such embodiment, one or more predefined wager packages are associated with placing a plurality of wagers on a plurality of simultaneously displayed games. In this embodiment, a plurality of games are simultaneously or substantially simultaneously displayed on a common display and a wager on a designated predefined wager package causes a wager to be placed (and one or more game play features to be activated) on a plurality of the simultaneously played games. In another embodiment, one or more predefined wager packages are associated with placing a plurality of wagers on a plurality of sets of sequential games. In this embodiment, a wager on a designated predefined wager package causes a wager to be placed (and one or more game play features to be activated) on each of a plurality of subsequent sequentially played games.

In one embodiment, the gaming device disclosed herein enables a player to place one or more additional wagers via a predefined wager package to activate one or more functions or features of the gaming device. In one such embodiment, the gaming device enables the player to determine, via the amount of the wager placed in association with a predefined wager package, one or more additional functions for one or more symbols. Such additional symbol functions, as described in more detail below, provide the player with one or more advantages over a player who does not select to place a wager on a predefined wager package associated with the activation of such symbol functions. That is, by selecting to wager on a predefined wager package associated with the gaming device activating at least one additional symbol function, a player is provided additional award winning opportunities that would otherwise not be available to the player.

In one embodiment, the gaming device enables the player to place a wager on a predefined wager package which causes the gaming device to activate one or more secondary symbol features. In this embodiment, a plurality of primary symbols on the reels are each associated with a secondary symbol, such as a sub-symbol, that is activated if the player selects to wager on a predefined wager package associated with such game play features. If one or more of such secondary symbols are generated in a suitable configuration during one or more plays of a game, one or more awards are provided to the player (which would otherwise not have been provided if the player did not place the wager associated with the predefined wager package associated with activating the secondary symbols).

In one example embodiment, if the player places a wager on one of the predefined wager packages, the gaming device activates one or more secondary symbols for one or more plays of a game. In this embodiment, if such activated secondary symbols (or the primary symbols associated with such activated secondary symbols) are generated in any symbol positions on the reels to form a winning symbol combination (i.e., a scatter configuration), the gaming device provides an award to the player. For example, as seen in FIG.

Figure 4A:
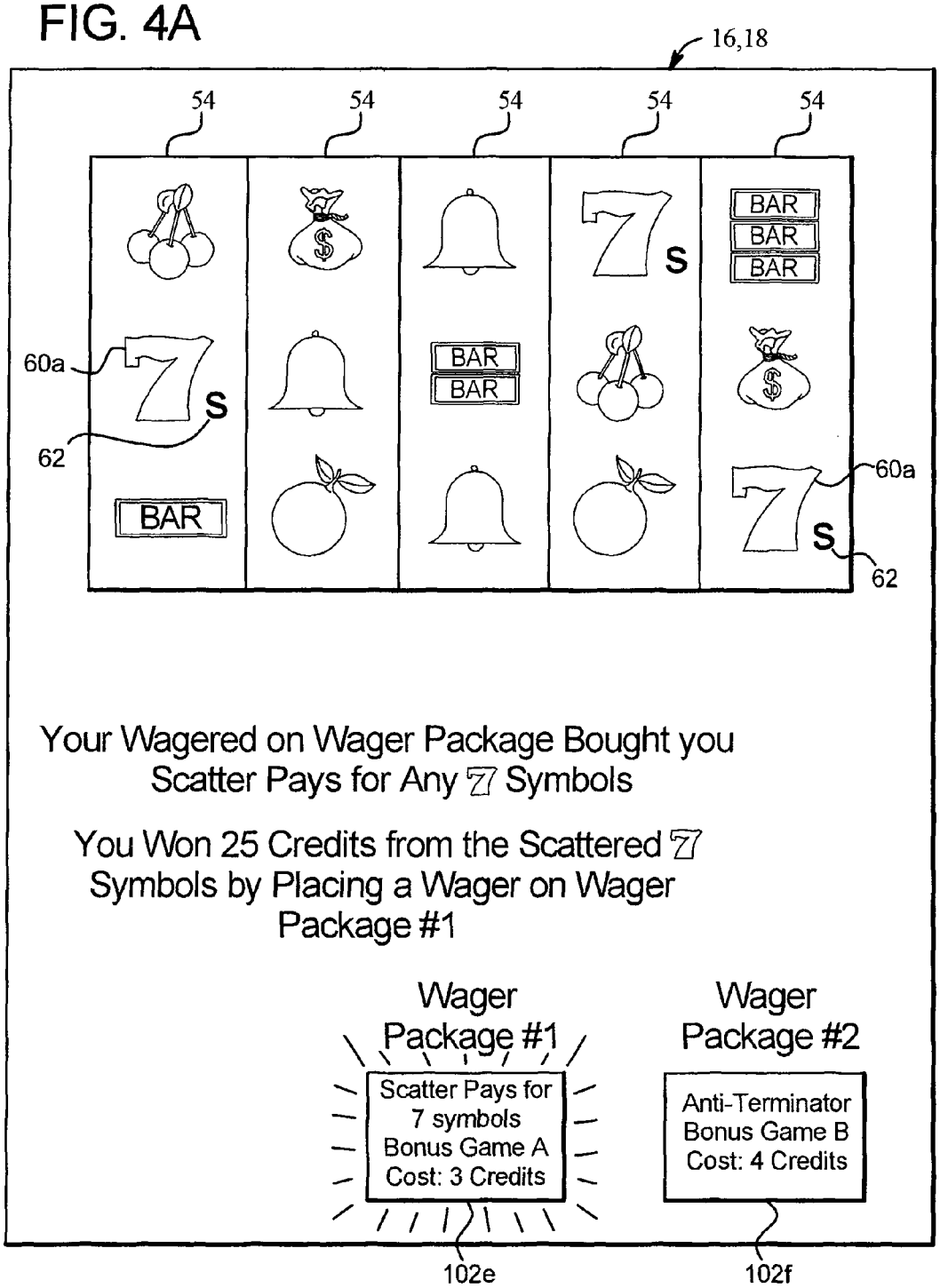
FIG. 4A is top plan view of one embodiment disclosed herein illustrating a predefined wager package which causes a scatter pay configuration to be applicable for a play of a game.

4A, after the player wagered 3 credits on predefined wager package #1 102*e* to activate one or more sub-symbols 62, the gaming device generated a plurality of primary symbols. In this example, the sub-symbols are associated with the seven symbols 60*a*, however it should be appreciated that the sub-symbols could be associated with any one or more of the primary symbols. In this example, since three seven symbols (which are each associated with an activated sub-symbol) are generated in three symbol positions on the reels in a scatter configuration (and not just along a wagered on payline), the gaming device provides to the player an award associated with a symbol combination of three seven symbols. Appropriate messages such as "YOUR WAGERED ON WAGER PACKAGE BOUGHT YOU SCATTER PAYS FOR ANY 7 SYMBOL" and "YOU WON 25 CREDITS FROM THE SCATTERED 7 SYMBOLS BY PLACING A WAGER ON WAGER PACKAGE #1" may be provided to the player visually, or through suitable audio or audiovisual displays. It should be appreciated that had the player not placed the wager associated with predefined wager package #1 (but had placed the wager on wager package #2 102*f*) and the symbols were generated as seen in FIG. 4A, the player would have not been provided an award for the generated seven symbols (because the seven symbols were not generated along a wagered on payline). In this instance, appropriate messages such as "YOU WOULD HAVE WON THE SCATTERED 7 SYMBOLS HAD YOU SELECTED WAGER PACKAGE #1" may be provided to the player visually, or through suitable audio or audiovisual displays.

Figure 4B:
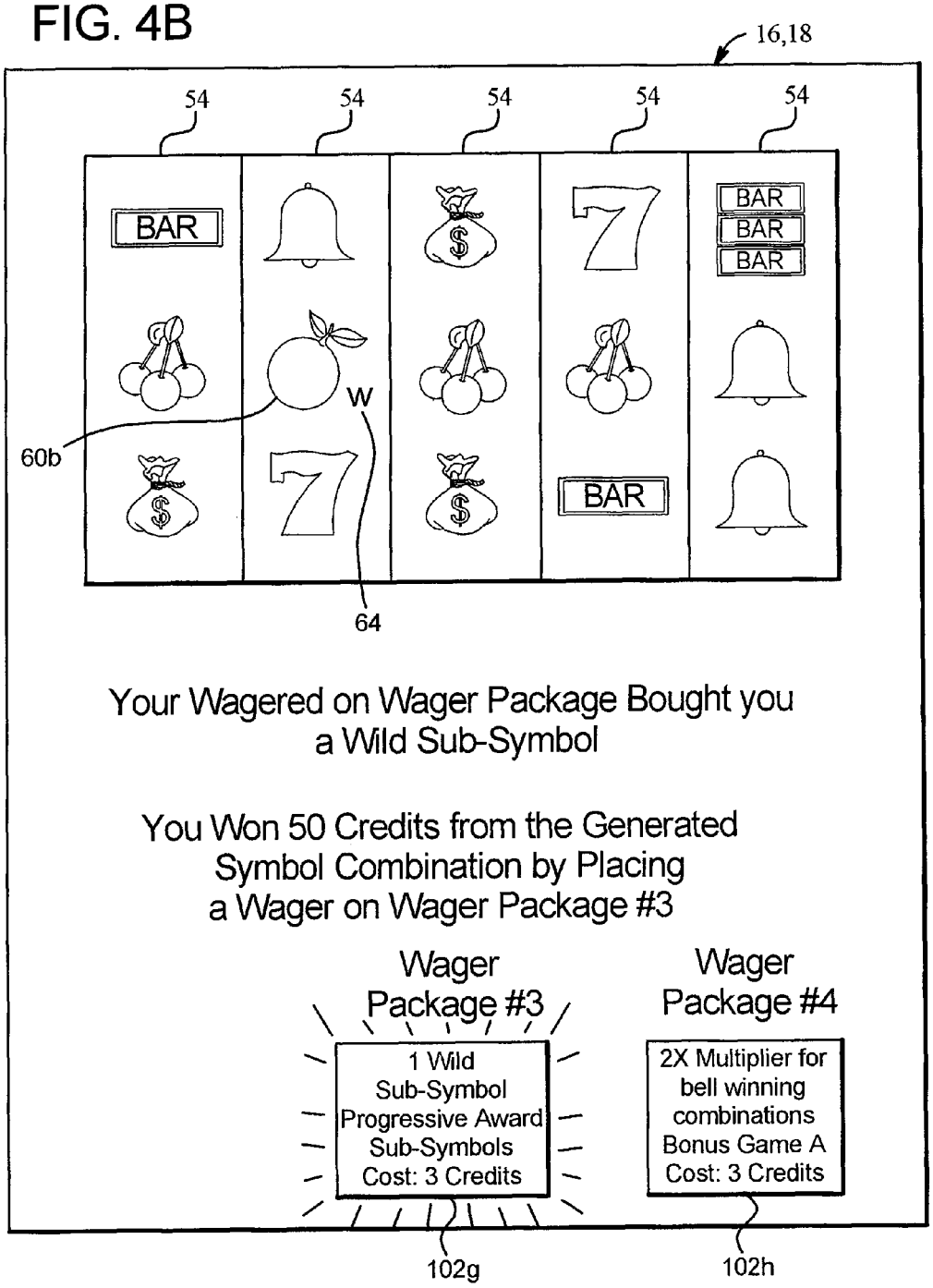
FIG. 4B is a top plan view of one embodiment disclosed herein illustrating a predefined wager package which causes a wild sub-symbol to be applicable for a play of a game.

In another example embodiment, if the player places a wager on one of the predefined wager packages, the gaming device activates one or more wild secondary symbols for one or more plays of a game. In this embodiment, if such activated wild secondary symbols are generated, the generated primary symbol associated with the generated wild secondary symbol functions as a wild symbol for at least one play of the game. For example, as seen in FIG. 4B, after the player wagered 3 credits on predefined wager package #3 102*g* to activate one or more wild sub-symbols 64, the gaming device generated a plurality of primary symbols. In this example, the wild sub-symbol associated with the generated orange symbol 60*b* caused the generated orange symbol to function as a wild symbol and specifically to function as a cherry symbol. Accordingly, the gaming device provides the player the award associated with the symbol combination of cherry symbol—cherry symbol—cherry symbol—cherry symbol generated along a wagered on payline. Appropriate messages such as "YOUR WAGERED ON WAGER PACKAGE BOUGHT YOU A WILD SUB-SYMBOL" and "YOU WON 50 CREDITS FROM THE GENERATED SYMBOL COMBINATION BY PLACING A WAGER ON WAGER PACKAGE #3" may be provided to the player visually, or through suitable audio or audiovisual displays. It should be appreciated that had the player not placed the wager associated with predefined wager package #3 (but had placed the wager on wager package #4 102*h*) and the symbols were generated as seen in FIG. 4B, the generated orange symbol would not function as a wild symbol (i.e., no generated associated wild sub-symbol) and the player would have not been provided an award for the generated symbol combination of cherry symbol—orange symbol—cherry symbol—cherry symbol.

In another example embodiment, if the player places a wager on one of the predefined wager packages, the gaming device activates one or more progressive award secondary symbols for one or more plays of a game. In this embodiment, if one or more of such activated progressive award secondary symbols are generated during a play of the game (either along a wagered on payline or in a scatter configuration), the gaming device provides the player a progressive award. In another example embodiment, if the player places a wager on one of the predefined wager packages, the gaming device activates one or more progressive award secondary symbols, such as progressive award sub-symbols, for one or more plays of a game. In this embodiment, if one or more of such activated progressive award secondary symbols are generated during a play of the game the gaming device provides the player a bonus sequence for a chance to win a progressive award. This example embodiment provides the player with a chance at winning a progressive award for placing a wager on a predefined wager package by using secondary symbols that are not otherwise available to be generated. The bonus sequence may be any suitable type of game which provides a player a chance at winning one or more progressive awards. In different embodiments, the bonus sequence includes, but not limited to, reel/slot games, card games (e.g., poker, blackjack), lottery games, selection games, offer and acceptance games, wheel games, dice games, free spin games, competition games, skill games, perceived skill games or games that include one or more rounds of game play.

In one such embodiment, which, if any, of a plurality of progressive awards (such as the progressive awards of an MLP configuration described above) provided to the player is based on the progressive award secondary symbol(s) generated. In another such embodiment, which, if any, of a plurality of progressive awards provided to the player is based on the predefined wager package selected and wagered on by the player. In another such embodiment, which, if any, of a plurality of progressive awards provided to the player is based on the player's status (as determined through a player tracking system). In different embodiments, which, if any, of the plurality of progressive awards provided to the player is predetermined, randomly determined, determined based on a generated symbol or symbol combination, determined based on a random determination by the central controller, determined based on a random determination at the gaming machine, determined based on time (such as the time of day), determined based on a primary game wager, determined based on an amount of coin-in accumulated in one or more pools, or determined based on any other suitable method or criteria.

In another example embodiment, if the player places a wager on one of the predefined wager packages, the gaming device activates one or more bonus game secondary symbols, such as bonus game sub-symbols, for one or more plays of a game. In this embodiment, if one or more of such activated bonus game secondary symbols are generated during a play of the game (either along a wagered on payline or in a scatter configuration), the gaming device enables the player to participate in a bonus game for one or more bonus awards. This example embodiment provides the player with a chance at playing a bonus game for placing a wager on a predefined wager package by using secondary symbols that are not otherwise available to be generated. The bonus game may be any suitable type of game including, but not limited to, reel/slot games, card games (e.g., poker, blackjack), lottery games, selection games, offer and acceptance games, wheel games, dice games, free spin games, competition games, skill games, perceived skill games or games that include one or more rounds of game play.

In one such embodiment, which of a plurality of bonus games the gaming device enables the player to play is based on the bonus game secondary symbol(s) generated. In another such embodiment, which of a plurality of bonus games the gaming device enables the player to play is based on the predefined wager package the player selected to wager on. In another such embodiment, which of a plurality of bonus games the gaming device enables the player to play is based on the player's status (as determined through a player tracking system). In different embodiments, which of the plurality of bonus games the gaming device enables the player to play is predetermined, randomly determined, determined based on a generated symbol or symbol combination, determined based on a random determination by the central controller, determined based on a random determination at the gaming machine, determined based on time (such as the time of day), determined based on a primary game wager, determined based on an amount of coin-in accumulated in one or more pools, or determined based on any other suitable method or criteria.

In one embodiment, wagering on one of the predefined wager packages causes the gaming device to activate at least one secondary symbol. In another embodiment, wagering on one of the predefined wager packages causes the gaming device to activate a plurality of secondary symbols. In one embodiment, a plurality of the reels each include at least one secondary symbol activated upon the player selecting to wager on one of the predefined wager packages. In another embodiment, a plurality of the reels each include a plurality of secondary symbols activated upon the player selecting to wager on one of the predefined wager packages. In another embodiment, each of the reels includes at least one secondary symbol activated upon the player selecting to wager on one of the predefined wager packages. In another embodiment, each of the reels includes a plurality of secondary symbols activated upon the player selecting to wager on one of the predefined wager packages. In different embodiments, the location of each secondary symbol on the reels is predetermined, randomly determined, determined based on a player's status (such as determined through a player tracking system), determined based on a generated symbol or symbol combination, determined based on a random determination by the central controller, determined based on a random determination at the gaming machine, determined based on a wager associated with an appropriate predefined wager package, determined based on time (such as the time of day), determined based on a primary game wager, determined based on an amount of coin-in accumulated in one or more pools, or determined based on any other suitable method or criteria.

In one embodiment, the wager amount associated with a predefined wager package determines the number of activated secondary symbols for that predefined wager package. In another embodiment, the wager amount associated with a predefined wager package and the player's status (as determined through a player tracking system) determines the number of activated secondary symbols for that predefined wager package. For example, the gaming device activates a first number of secondary symbols when a first player of a first player status places a wager on a first predefined wager package and the gaming device activates a greater second number of secondary symbols when a second player of a second greater status places the same wager on the same predefined wager package. In different embodiments, the number of activated secondary symbols is predetermined, randomly determined, determined based on a primary game wager, determined based on a generated symbol or symbol combination, determined based on a random determination by the central controller, determined based on a random determination at the gaming machine, determined based on time (such as the time of day), determined based on an amount of coin-in accumulated in one or more pools, or determined based on any other suitable method or criteria.

In one embodiment, one or more secondary symbols are associated with one primary symbol. In another embodiment, one or more secondary symbols are each associated with a plurality of primary symbols. In different embodiments, which secondary symbols are associated with which primary symbols, if any, is predetermined, randomly determined, determined based on a player's status (such as determined through a player tracking system), determined based on a generated symbol or symbol combination, determined based on a random determination by the central controller, determined based on a random determination at the gaming machine, determined based on the predefined wager package wagered on, determined based on time (such as the time of day), determined based on a primary game wager, determined based on an amount of coin-in accumulated in one or more pools, or determined based on any other suitable method or criteria.

In one embodiment, which predefined wager package the player wagered on determines the number of plays of the game which the secondary symbols remains activated. In one embodiment, if a secondary symbol is activated, the secondary symbol is active for one play of the game. In another embodiment, if a secondary symbol is activated, the secondary symbol is active for a plurality of plays of the game. In one embodiment, if a secondary symbol is activated, the secondary symbol remains active until a terminating condition occurs, such as the generation of a terminator symbol. In different embodiments, the number of games an activated secondary symbol remains active for is predetermined, randomly determined, determined based on a player's status (such as determined through a player tracking system), determined based on a generated symbol or symbol combination, determined based on a random determination by the central controller, determined based on a random determination at the gaming machine, determined based on time (such as the time of day), determined based on a primary game wager, determined based on an amount of coin-in accumulated in one or more pools, or determined based on any other suitable method or criteria.

In one embodiment, one or more secondary symbols are generated and displayed to the player if activated, but not generated and displayed to the player if inactive (i.e., not activated). In another embodiment, one or more secondary symbols are generated and displayed to the player regardless of whether such secondary symbols are activated or not. In this embodiment, inactive secondary symbols are dimmed or otherwise suitably differentiated from activated secondary symbols. It should be appreciated that by displaying any inactive secondary symbols, the gaming device informs the player of any awards they had won had they placed a wager on one of the predefined wager packages to activate the secondary symbols.

In another embodiment, the gaming device enables the player to place a wager on a predefined wager package which provides that one or more designated symbols will function as wild symbols if such symbols are generated on the reels. In one such embodiment, as the player increases their wager and selects a different predefined wager package, a greater number of designated symbols will function as wild symbols if such symbols are generated on the reels. For example, one predefined wager package associated with a wager of two credits causes all single bar symbols to function as wild symbols and a different predefined wager package associated with a wager of three credits causes all single bar symbols and all double bar symbols to function as wild symbols. This configuration provides that by wagering on a specific predefined wager package to increase their odds of generating one or more wild symbols, the player is increasing their odds that one or more winning symbols combinations will be generated and one or more awards will be provided to the player.

In one embodiment, if the player places a wager on one of the predefined wager packages, the gaming device causes one or more designated symbols located on one or more designated reels to function as wild symbols. In another embodiment, if the player places a wager on one of the predefined wager packages, the gaming device causes one or more designated symbols located on each of the reels to function as wild symbols. In different embodiments, if the player places a wager on one of the predefined wager packages, which symbols that will function as wild symbols are predetermined, randomly determined, determined based on a player's status (such as determined through a player tracking system), determined based on a generated symbol or symbol combination, determined based on a random determination by the central controller, determined based on a random determination at the gaming machine, determined based on time (such as the time of day), determined based on a primary game wager, determined based on any wager associated with an appropriate predefined wager package, determined based on an amount of coin-in accumulated in one or more pools, or determined based on any other suitable method or criteria.

In one embodiment, the amount of the wager associated with the predefined wager package determines the number of plays of the game which the designated symbol(s) function as wild symbols. In one embodiment, if the player places a wager on one of the predefined wager packages, the designated symbol(s) will function as wild symbols until a terminating condition occurs, such as the generation of a terminator symbol. In different embodiments, the number of games which the designated symbol(s) function as wild symbols is predetermined, randomly determined, determined based on a player's status (such as determined through a player tracking system), determined based on a generated symbol or symbol combination, determined based on a random determination by the central controller, determined based on a random determination at the gaming machine, determined based on time (such as the time of day), determined based on a primary game wager, determined based on an amount of coin-in accumulated in one or more pools, or determined based on any other suitable method or criteria.

In another embodiment, the gaming device enables the player to select and wager on one of the predefined wager packages which modifies the number of one or more designated symbols in the symbol set for one or more plays of a game. In one such embodiment, selecting and wagering on one of the predefined wager packages to increase the number of a designated symbol in a symbol set increases the probability that such designated symbol is generated which increases the player's probability of winning an award (if the designated symbol is included in one or more winning symbol combinations). For example, if cherry symbols are included in a plurality of winning symbol combinations and a player's placement of a wager associated with one of the predefined wager packages increases the number of cherry symbols which may be generated in a play of the game, then the player's placement of such a wager associated with the predefined wager package also increases the probability that an award will be provided to the player if a winning symbol combination (which includes a cherry symbol) is generated. In another such embodiment, if the player is playing a collection game wherein they are provided awards for collecting a number of designated symbols, selecting and wagering on one of the predefined wager packages causes the gaming device to increase the number of designated symbols available to the player, thus increasing the player's odds of collecting the amount of designated symbols required to win an award in the collection game.

It should be appreciated that one or more of the above described game play features which are associated one or more of the predefined wager packages may be combined or included in one or more plays of a game. In one such embodiment, which game play function is associated with which predefined wager package is based on the amount of the wager associated with that wager package. In another embodiment, which game play function is associated with which predefined wager package is based on a player's status (as determined through a player tracking system). In different embodiments, the type of game play function(s) associated with one or more predefined wager amounts are predetermined, randomly determined, determined based on a generated symbol or symbol combination, determined based on a random determination by the central controller, determined based on a random determination at the gaming machine, determined based on time (such as the time of day), determined based on a primary game wager, determined based on an amount of coin-in accumulated in one or more pools, or determined based on any other suitable method or criteria.

In another embodiment, if a player wagers on a predefined wager package to cause the gaming device to activate one or more symbol features (or other enhanced game play features), these wagered on enhanced symbols (or other game play features) are determined remotely at the central server and communicated to the gaming device. This embodiment provides that such wagered on symbol features (or other game play features) are compatible with any type of game played on a gaming device.

It should be further appreciated that the above described game play features which are associated with one or more of the predefined wager packages provide the player a visual benefit for their increased wager. In contrast to enabling a player to wager more per payline wherein the player sees a multiplied result if a win occurs, the gaming device disclosed displays a visible and tangible result at an increased frequency for their wager associated with a predefined wager package. Such a configuration provides increased excitement and enjoyment for players because the gaming device displays the increased award winning opportunities associated with the selected predefined wager package.

In another embodiment, if the player places a wager on one of the predefined wager packages, the gaming device causes one or more symbols to function as split symbols or N count symbols. A split or N count symbol is a symbol that includes a plurality of individual symbols in a single symbol position. In this embodiment, when evaluating the generated symbols to determine if a winning symbol or combination of symbols is generated, the gaming device accounts for each individual symbol generated in a single symbol position. Thus, a split symbol increases the likelihood that a winning symbol combination of symbols will be generated on the reels. It should be appreciated that by selecting and wagering on one of the predefined wager packages to activate one or more split symbols, the player's excitement and enjoyment of the game increases because the player believes that they have a better opportunity to obtain a winning symbol combination and thereby an award in the game.

In one such embodiment, the greater the wager amount associated with a predefined wager package, the greater the number of symbols generated in a single symbol position. Such a configuration provides increased excitement for players because they are enabled to actively see how their wager is helping them in the game by causing winning symbol combinations to be generated based on the additional symbols generated in one or more symbol positions (that would not otherwise be generated if the player had not selected to wager on the same wager package). For example, placing a wager of 5 credits associated with a first predefined wager package causes two symbols to be generated in at least one of the single symbol positions, while placing a wager of 10 credits associated with a second predefined wager package causes three symbols to be generated in at least one of the single symbol positions. In different embodiments, if the player places a wager on one of the predefined wager packages, the number of symbols generated in a single symbol position is predetermined, randomly determined, determined based on a generated symbol or symbol combination, determined based on a random determination by the central controller, determined based on a random determination at the gaming machine, determined based on time (such as the time of day), determined based on a primary game wager, determined based on an amount of coin-in accumulated in one or more pools, or determined based on any other suitable method or criteria.

In another such embodiment, the greater the wager amount associated with a predefined wager package, the greater the number of single symbol positions which each include a plurality of symbols. For example, placing a wager of 5 credits associated with a first predefined wager package causes one individual symbol position to include a plurality of symbols, while placing a wager of 10 credits associated with a second predefined wager package causes two individual symbol positions to each include a plurality of symbols. In different embodiments, if the player places a wager on one of the predefined wager packages, the number of individual symbol positions which each include a plurality of symbols is predetermined, randomly determined, determined based on a generated symbol or symbol combination, determined based on a random determination by the central controller, determined based on a random determination at the gaming machine, determined based on time (such as the time of day), determined based on a primary game wager, determined based on an amount of coin-in accumulated in one or more pools, or determined based on any other suitable method or criteria.

Figure 5A:
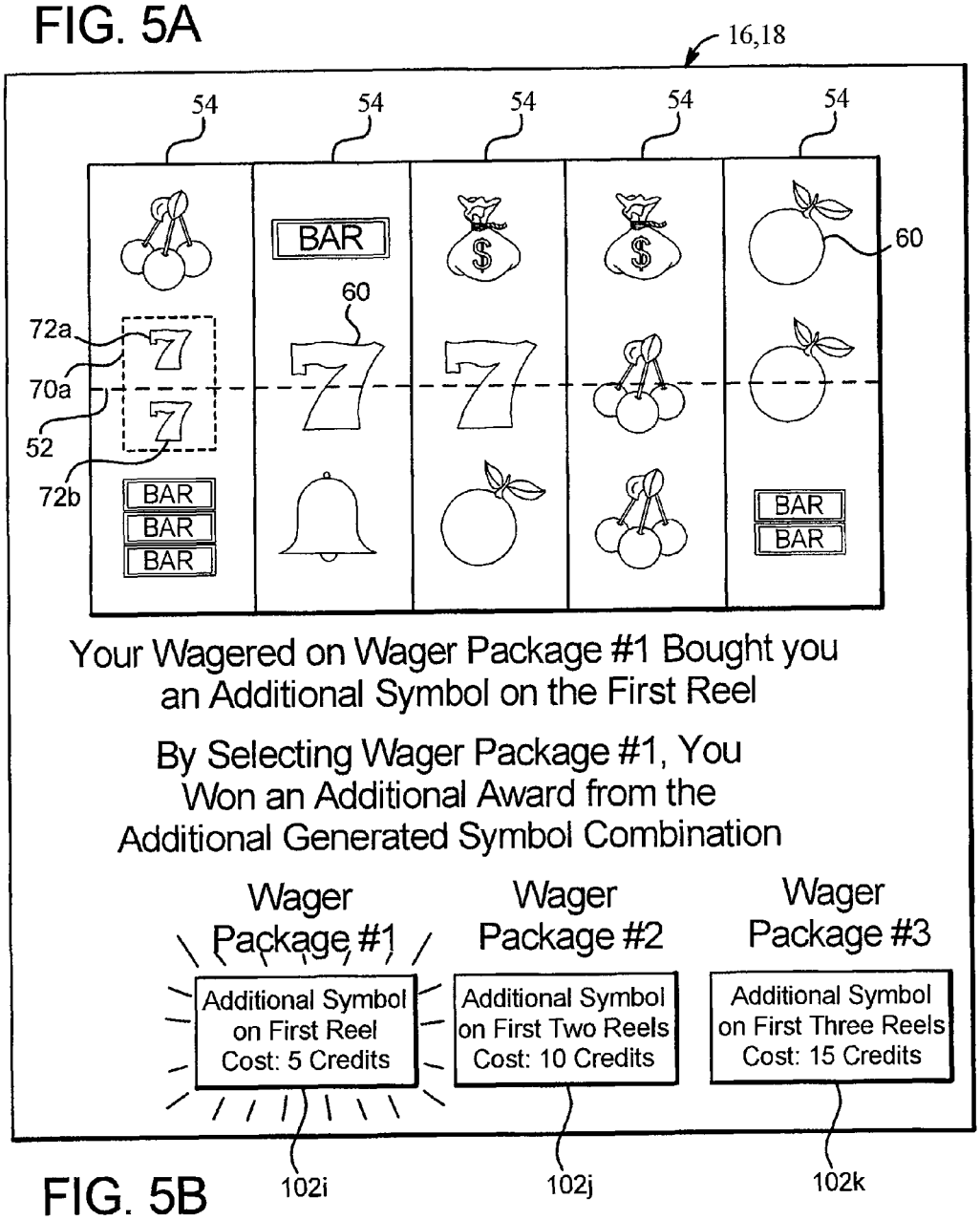
FIG. 5A is top plan view of one embodiment disclosed herein illustrating a predefined wager package which causes an additional symbol to be generated in at least one symbol position.
Figure 5B:
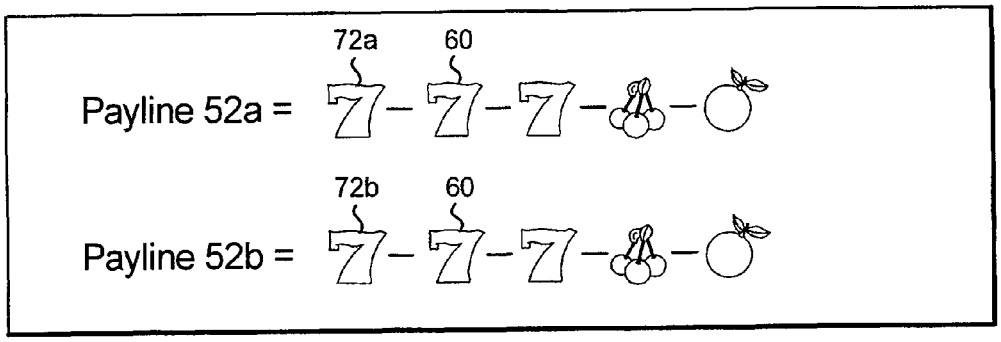
FIG. 5B is a top plan view of the symbols generated along a plurality of the paylines of the example of FIG. 5A.

In one embodiment, if the player places a wager on one of the predefined wager packages, the split symbols are utilized to create additional winning symbol combinations along one or more supplemental paylines which are derived from the wagered on payline. For example, as seen in FIG. 5A, after the player placed a wager of five credits associated with predefined wager package #1 102*i* to cause one symbol position on the first reel to simultaneously generate two identical symbols, the gaming device generated a plurality of symbols. In this example, the middle symbol position 70*a* of the first reel 54*a* generated two seven symbols 72*a* and 72*b* and each of the remaining symbol positions generated one symbol along activated payline 52. Such a generation resulted in two separate winning symbol combinations along activated payline 52 (illustrated as supplemental paylines 52*a* and 52*b* in FIG. 5B) and thus the gaming device provided two awards to the player (i.e., one award associated with each generated winning symbol combination). This embodiment provides the player with a greater number of winning opportunities through these additionally derived paylines. Appropriate messages such as "YOUR WAGERED ON WAGER PACKAGE #1 BOUGHT YOU AN ADDITIONAL SYMBOL ON THE FIRST REEL" and "BY SELECTING WAGER PACKAGE #1, YOU WON AN ADDITIONAL AWARD FROM THE ADDITIONAL GENERATED SYMBOL COMBINATION" may be provided to the player visually, or through suitable audio or audiovisual displays.

Figure 5C:
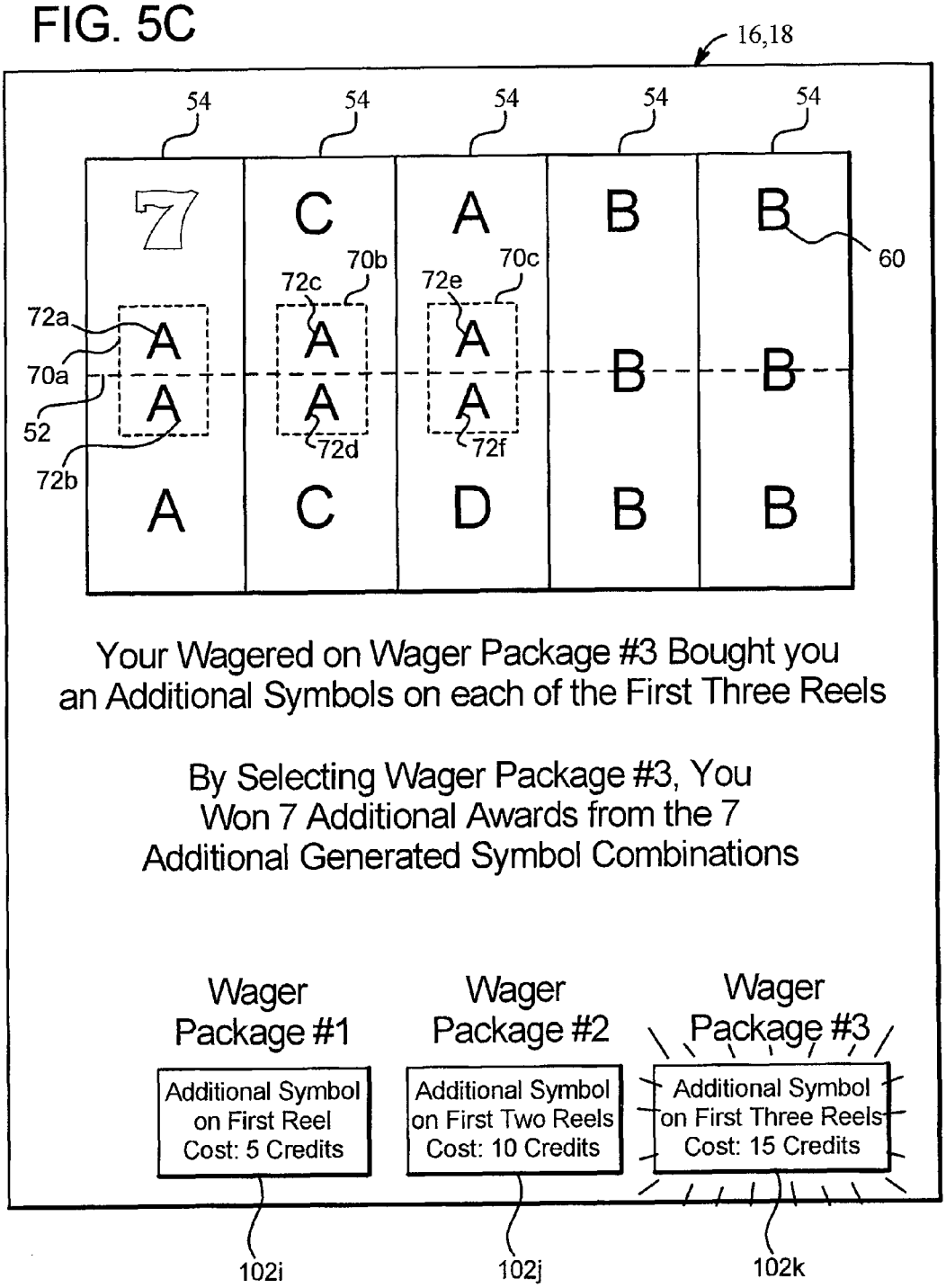
FIG. 5C is top plan view of one embodiment disclosed herein illustrating a predefined wager package which causes an additional symbol to be generated in a plurality of symbol positions.
Figure 5D:
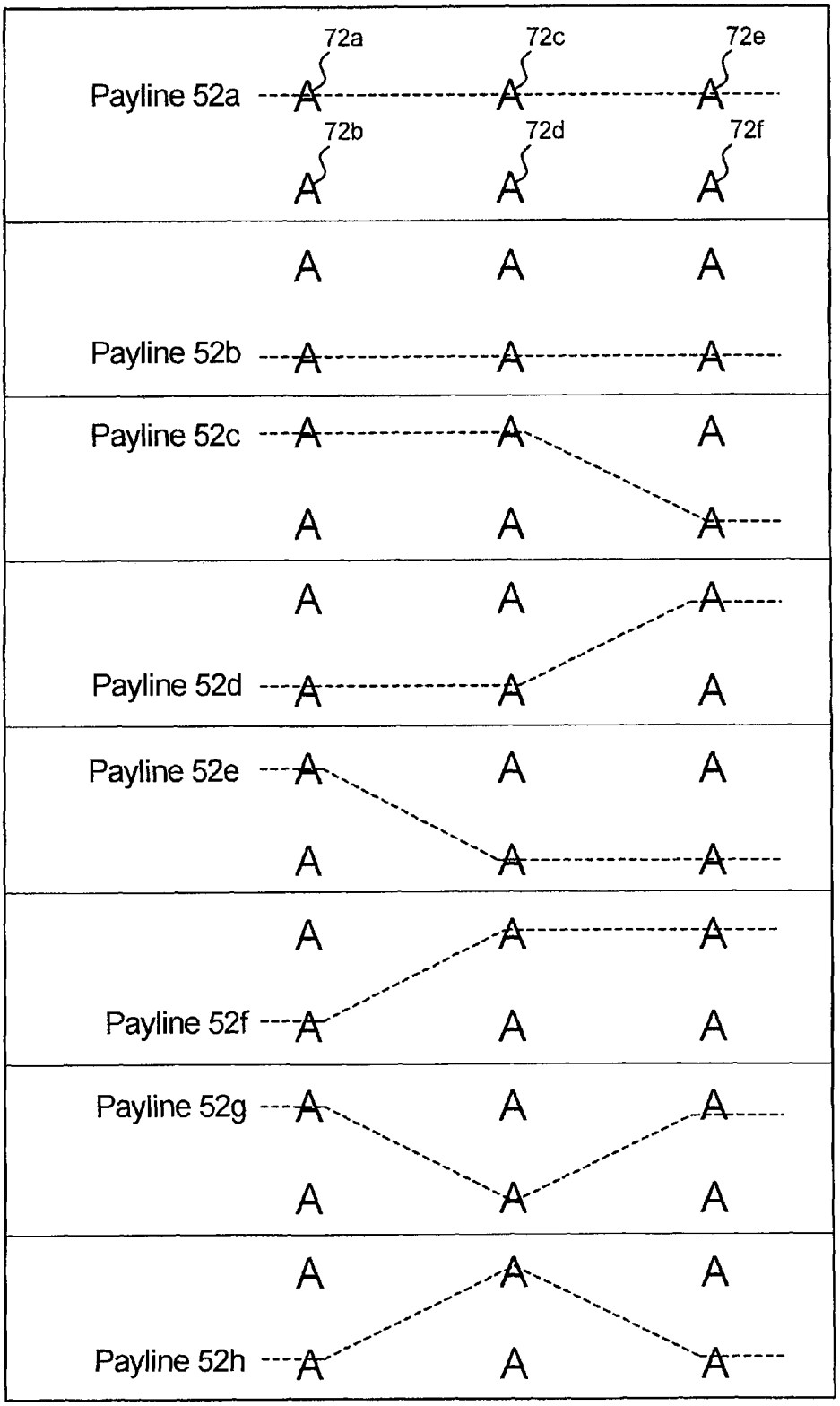
FIG. 5D is a top plan view of the symbols generated along a plurality of the paylines of the example of FIG. 5C.

In another embodiment, as mentioned above, the greater the wager associated with the predefined wager package, the greater the number of symbols positions which each generate a plurality of symbols. For example, as seen in FIG. 5C, after the player placed a wager of fifteen credits associated with predefined wager package #3 102*k* to cause three symbol positions to each simultaneously generate two identical symbols, the gaming device generated a plurality of symbols. In this example, the middle symbol position 70*a* of the first reel 54*a* generated two A symbols 72*a* and 72*b*, the middle symbol position of the second reel 54*b* generated two A symbols 72*c* and 72*d*, the middle symbol position of the third reel 54*c* generated two A symbols 72*e* and 72*f* and each of the remaining symbol positions generated one symbol along activated payline 52. Such a generation resulted in eight separate winning symbol combinations along activated payline 52 (illustrated as supplemental paylines 52*a* to 52*h* in FIG. 5D) and thus the gaming device provided eight awards to the player (i.e., one award associated with each generated winning symbol combination). Appropriate messages such as "YOUR WAGERED ON WAGER PACKAGE #3 BOUGHT YOU AN ADDITIONAL SYMBOL ON THE FIRST THREE REELS" and "BY SELECTING WAGER PACKAGE #3, YOU WON 7 ADDITIONAL AWARD FROM THE 7 ADDITIONAL GENERATED SYMBOL COMBINATIONS" may be provided to the player visually, or through suitable audio or audiovisual displays.

In another embodiment (not shown), if the player places a wager on one of the predefined wager packages, the split symbols are utilized to create additional winning symbol combinations in a ways to win game. As discussed in above, in a ways to win game, the gaming device determines any award to provide to the player based on the number of related symbols which are generated in wagered on or otherwise active symbol positions. In this embodiment, the gaming device analyzes the symbols generated and displayed in the active symbol positions to determine whether the symbols form a string of related symbols. If one or more strings of related symbols are formed in the game, the gaming device evaluates the symbols of each string of related symbols to determine whether those symbols correspond to any winning combinations of symbols. If so, the gaming device provides any outcomes, such as awards, associated with such winning combinations of symbols to the player. In this embodiment, if a split symbol is generated in an active symbol position, each of the individual symbols which form the split symbol are analyzed separately in determining whether the symbols form a string of related symbols.

Specifically, in one such embodiment, the gaming device individually determines if a symbol generated in an active symbol position on one reel forms part of a winning symbol combination with or is otherwise suitably related to a symbol generated in the same active symbol position (if that active symbol position includes a plurality of symbols) or an active symbol position on an adjacent reel. In this embodiment, the gaming device classifies each pair of symbols which form part of a winning symbol combination (i.e., each pair of related symbols) as a string of related symbols. After determining if any strings of related symbols are formed between these symbols, the gaming device determines if any of the symbols in the same active symbol position (if that active symbol position includes a plurality of symbols) or an active symbol position on the next adjacent reel should be added to any of the formed strings of related symbols.

In this embodiment, for a first of the classified strings of related symbols, the gaming device determines if any of the symbols generated in the same active symbol position (if that active symbol position includes a plurality of symbols) or an active symbol position on the next adjacent reel form part of a winning symbol combination or are otherwise related to the symbols of the first string of related symbols. If the gaming device determines that a symbol generated in the same active symbol position (if that active symbol position includes a plurality of symbols) or an active symbol position on the next adjacent reel is related to the symbols of the first string of related symbols, that symbol is subsequently added to the first string of related symbols. On the other hand, if the gaming device determines that no symbols generated in the same active symbol position (if that active symbol position includes a plurality of symbols) or an active symbol position on the next adjacent reel are related to the symbols of the first string of related symbols, the gaming device marks or flags such string of related symbols as complete.

After either adding a related symbol to the first string of related symbols or marking the first string of related symbols as complete, the gaming device proceeds as described above for each of the remaining classified strings of related symbols which were previously classified or formed from related symbols. After analyzing each of the remaining strings of related symbols, the gaming device determines, for each remaining pending or incomplete string of related symbols, if any of the symbols in the same active symbol position (if that active symbol position includes a plurality of symbols) or an active symbol position on the next adjacent reel if any, should be added to any of the previously classified strings of related symbols. This process continues until either each string of related symbols is complete or there are no more symbols to analyze. In this embodiment, where there are no more adjacent symbols to analyze, the gaming device marks each of the remaining pending strings of related symbols as complete. When each of the strings of related symbols is marked complete, as described above, the gaming device compares each of the strings of related symbols to an appropriate paytable and provides the player any award associated with each of the completed strings of symbols.

In another embodiment, if the player places a wager on one of the predefined wager packages, the split symbols are utilized to create additional winning symbol combinations along a single payline. In this embodiment, by generating additional symbols on the reels, the gaming device is operable to form additional winning symbol combinations that would otherwise not be available without the player selecting and wagering on one of the predefined wager packages. For example, on a five reel slot gaming device, if a wager associated with one of the predefined wager packages is placed to cause the gaming device to generate an additional symbol at one of the symbol positions along an active payline, then an award associated with a six symbol winning combination may be provided to the player. In different embodiments, upon placing the wager associated with one of the predefined wager packages to cause at least one symbol position to generate at least one additional symbol, the gaming device analyzes the symbols generated as described in co-pending U.S. patent application Ser. No. 10/650,247.

In one embodiment, upon the player placing a wager on one of the predefined wager packages, a plurality of the reels each include at least one symbol position operable to generate a plurality of individual symbols. In another embodiment, upon the player placing a wager on one of the predefined wager packages, a plurality of the reels each include a plurality symbol positions that are each operable to generate a plurality of individual symbols. In another embodiment, upon the player placing a wager on one of the predefined wager packages, each of the reels includes at least one symbol position operable to generate a plurality of individual symbols. In another embodiment, upon the player placing a wager on one of the predefined wager packages, each of the reels includes a plurality of symbol positions that are each operable to generate a plurality of individual symbols. In different embodiments, upon the player placing a wager on one of the predefined wager packages, the location of each symbol position that is operable to generate a plurality of individual symbols is predetermined, randomly determined, determined based on a player's status (such as determined through a player tracking system), determined based on a generated symbol or symbol combination, determined based on a random determination by the central controller, determined based on a random determination at the gaming machine, determined based on time (such as the time of day), determined based on a primary game wager, determined based on the wagered on predefined wager package, determined based on an amount of coin-in accumulated in one or more pools, or determined based on any other suitable method or criteria.

In one embodiment, if the player places a wager on one of the predefined wager packages, the gaming device generates a plurality of identical symbols in at least one symbol position. In another embodiment, if the player places a wager on one of the predefined wager packages, the gaming device generates a plurality of identical symbols in each of a plurality of symbol positions. In different embodiments, the number of symbol positions which the gaming device generates a plurality of identical symbols is predetermined, randomly determined, determined based on a player's status (such as determined through a player tracking system), determined based on a generated symbol or symbol combination, determined based on a random determination by the central controller, determined based on a random determination at the gaming machine, determined based on time (such as the time of day), determined based on a primary game wager, determined based on the wagered on predefined wager package, determined based on an amount of coin-in accumulated in one or more pools, or determined based on any other suitable method or criteria.

In one embodiment, if the player places a wager on one of the predefined wager packages, the gaming device generates a plurality of different symbols in at least one symbol position. In another embodiment, if the player places a wager on one of the predefined wager packages, the gaming device generates a plurality of different symbols in each of a plurality of symbol positions. In different embodiments, the number of symbol positions which the gaming device generates a plurality of different symbols is predetermined, randomly determined, determined based on a player's status (such as determined through a player tracking system), determined based on a generated symbol or symbol combination, determined based on a random determination by the central controller, determined based on a random determination at the gaming machine, determined based on time (such as the time of day), determined based on a primary game wager, determined based on the wagered on predefined wager package, determined based on an amount of coin-in accumulated in one or more pools, or determined based on any other suitable method or criteria.

It should be appreciated that in one embodiment, one or more of the game play features disclosed herein do not need to be wagered on as part of a predefined wager package. In this embodiment, one or more of these game play features may be wagered on individually. In one such embodiment, such individual game play features are wagered on in conjunction with a player wagering on a predefined wager package. In another such embodiment, such individual game player features are wagered on independent of any predefined wager packages.

In one embodiment, upon the player making a single input to select a predefined wager package, the gaming device initiates a game utilizing the game player features of the selected predefined wager package. In another embodiment, upon the player making a single input to select a predefined wager package, the player must make at least one additional input to cause the gaming device to initiate a game utilizing the game player features of the selected predefined wager package.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming system comprising:

a plurality of input devices including an acceptor and a cashout device;

at least one display device;

at least one processor; and at least one memory device which stores a plurality of instructions executable by the at least one processor to cause the at least one processor to operate with the at least one display device, and the plurality of input devices to:

(a) responsive to a physical item being received via the acceptor, establish a credit balance based at least in part, on a monetary value associated with the received physical item;

(b) display a first predefined wager package and a second predefined wager package, wherein said first predefined wager package is associated with a first wager amount greater than zero, a first average expected payout, a first plurality of primary game play features, and a first range of award values and the second predefined wager package is associated with the first wager amount, the first average expected payout, a second different plurality of primary game play features, and a different second range of award values;

(c) upon receiving a single input by a player, select one of: the displayed first predefined wager package and the displayed second predefined wager package, wherein said single input is selected from the group consisting of: a single press of a button and a single touch of a touch screen associated with the at least one display device;

(d) enable the player to play a primary game, wherein said primary game includes said primary game play features associated with said selected predefined wager package;

(e) randomly determine an outcome for said primary game;

(f) determine an award value for said primary game based on said determined outcome, wherein said determined award value is from the range of award values of the selected predefined wager package;

(g) display said determined award value, wherein the credit balance is increasable based on the determined award value; and (h) responsive to a cashout input being received via the cashout device, cause an initiation of any payout associated with the credit balance.

2. The gaming system of claim 1, wherein the highest award value in the first range of award values is greater than the highest award value in the second range of award values.

3. The gaming system of claim 1, wherein the lowest award value in the first range of award values is lower than the lowest award value in the second range of award values.

4. The gaming system of claim 1, wherein the highest award value in the first range of award values is greater than the highest award value in the second range of award values and the lowest award value in the first range of award values is lower than the lowest award value in the second range of award values.

5. The gaming system of claim 1, wherein when executed by the at least one processor, said plurality of instructions cause the at least one processor to select a third predefined wager package upon receiving the single input by the player, wherein the third predefined wager package is associated with a greater second wager amount and a greater second average expected payout.

6. The gaming system of claim 1, wherein at least one of the predefined wager packages includes at least one primary game play feature selected from the group consisting of: (i) a type of secondary game; (ii) a type of secondary award; (iii) if the player may win a progressive award; (iv) which one of a plurality of progressive awards the player may win; and (v) a primary game multiplier.

7. The gaming system of claim 1, wherein the primary game includes a plurality of reels and a plurality of paylines associated with the reels, wherein each reel includes a plurality of symbols and at least one of the predefined wager packages includes at least one primary game play feature selected from the group consisting of: (i) a number of active paylines; (ii) a number of active symbol positions; (iii) a number of wild symbols; (iv) a number of reel nudges; (v) a number of free activations of the reels; (vi) a number of symbols generated in each symbol position; and (vii) which type of symbol may be generated.

8. The gaming system of claim 1, wherein said plurality of input devices and said at least one display device reside in a housing remote from said at least one processor.

9. A gaming system comprising:

a plurality of input devices including an acceptor and a cashout device;

at least one display device;

at least one processor; and at least one memory device which stores a plurality of instructions executable by the at least one processor to cause the at least one processor to operate with the at least one display device, and the plurality of input devices to:

(a) responsive to a physical item being received via the acceptor, establish a credit balance based, at least in part on a monetary value associated with the received physical item;

(b) display a first predefined wager package, a second, different predefined wager package and a third, different predefined wager package, wherein each predefined wager package includes a total wager amount greater than zero and a number of a plurality of paylines to activate;

(c) enable a player to make a single input to select one of: the displayed first predefined wager package, the displayed second, different predefined wager package and the displayed third, different predefined wager package, wherein said single input is selected from the group consisting of: a single press of a button and a single touch of a touch screen associated with the at least one display device;

(d) enable the player to make an additional input to initiate a primary game;

(e) determine an award for the play of the initiated primary game, wherein said award is based on the selected predefined wager package;

(f) display the determined award, wherein the credit balance is increasable based on the determined award; and (g) responsive to a cashout input being received via the cashout device cause an initiation of any payout associated with the credit balance.

10. A method of operating a gaming system, said method comprising:

(a) responsive to a physical item being received via an acceptor, establishing a credit balance based, at least in part, on a monetary value associated with the received physical item:

(b) causing at least one display device to display a first predefined wager package and a second predefined wager package, wherein said first predefined wager package is associated with a first wager amount greater than zero, a first average expected payout, a first plurality of primary game play features, and a first range of award values and the second predefined wager package is associated with the first wager amount, the first average expected payout, a second different plurality of primary game play features, and a different second range of award values;

(c) upon receiving a single input by a player, selecting one of: the displayed first predefined wager package and the displayed second predefined wager package, wherein said single input is selected from the group consisting of: a single press of a button and a single touch of a touch screen associated with the at least one display device;

(d) enabling the player to play a primary game, wherein said primary game includes said primary game play features associated with said selected predefined wager package;

(e) causing at least one processor to execute a plurality of instructions to randomly determine an outcome for said primary game;

(f) causing the at least one processor to execute the plurality of instructions to determine an award value for said primary game based on said determined outcome, wherein said determined award value is from the range of award values of the selected predefined wager package;

(g) causing the at least one display device to display said determined award value, wherein the credit balance is increasable based on the determined award value; and (h) responsive to a cashout input being received via a cashout device, causing an initiation of any payout associated with the credit balance.

11. The method of claim 10, wherein the highest award value in the first range of award values is greater than the highest award value in the second range of award values.

12. The method of claim 10, wherein the lowest award value in the first range of award values is lower than the lowest award value in the second range of award values.

13. The method of claim 10, wherein the highest award value in the first range of award values is greater than the highest award value in the second range of award values and the lowest award value in the first range of award values is lower than the lowest award value in the second range of award values.

14. The method of claim 10, which includes selecting a third predefined wager package upon receiving the single input by the player, wherein the third predefined wager package is associated with a greater second wager amount and a greater second average expected payout.

15. The method of claim 10, wherein at least one of the predefined wager packages includes at least one game play feature selected from the group consisting of: (i) a type of secondary game the player may be eligible to play; (ii) a type of secondary award the player may win; (iii) if the player may win a progressive award; (iv) which one of a plurality of progressive awards the player may win; (v) a primary game multiplier; (vi) a number of active paylines; (vii) a number of active symbol positions; (viii) a number of wild symbols; (ix) a number of reel nudges; (x) a number of free reel spins; (xi) a number of symbols generated in each symbol position; and (xi) which type of symbol may be generated.

16. The method of claim 10, which is provided through a data network.

17. The method of claim 16, wherein the data network is an internet.

18. A method of operating a gaming system, said method comprising:

(a) responsive to a physical item received via an acceptor establishing a credit balance based at least in part, on a monetary value associated with the received physical item:

(b) causing at least one display device to display a first predefined wager package, a second, different predefined wager package and a third, different predefined wager package, wherein each predefined wager package includes a total wager amount greater than zero and a number of a plurality of paylines to activate;

(c) enabling a player to make a single input to select one of: the displayed first predefined wager package, the displayed second, different predefined wager package and the displayed third, different predefined wager package, wherein said single input is selected from the group consisting of: a single press of a button and a single touch of a touch screen associated with the at least one display device;

(d) enabling the player to make an additional input to initiate a primary game;

(e) causing at least one processor to execute a plurality of instructions to determine an award for the play of the initiated primary game, wherein said award is based on the selected predefined wager package;

(f) causing the at least one display device to display the determined award, wherein the credit balance is increasable based on the determined award; and (g) responsive to a cashout input being received via a cashout device, causing an initiation of any payout associated with the credit balance.

19. The method of claim 18, which is provided through a data network.

20. The method of claim 19, wherein the data network is an internet.

* * * * *